US006739160B1

(12) United States Patent
Hiraga et al.

(10) Patent No.: US 6,739,160 B1
(45) Date of Patent: May 25, 2004

(54) LINT-FREE WIPER

(75) Inventors: Satoshi Hiraga, Takatsuki (JP); Kazunari Nishiyama, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/600,490

(22) PCT Filed: Jan. 19, 1999

(86) PCT No.: PCT/JP99/00166

§ 371 (c)(1),
(2), (4) Date: Jul. 18, 2000

(87) PCT Pub. No.: WO99/35958

PCT Pub. Date: Jul. 22, 1999

(30) Foreign Application Priority Data

Jan. 19, 1998 (JP) ..... 10-007819

(51) Int. Cl.[7] ..... D04B 1/22
(52) U.S. Cl. ..... 66/170; 442/312
(58) Field of Search ..... 66/169 R, 170, 66/171, 202; 442/308, 304, 312, 318

(56) References Cited

U.S. PATENT DOCUMENTS

| | | | | |
|---|---|---|---|---|
| 2,263,787 A | * | 11/1941 | Safferson | 66/170 |
| 3,331,221 A | * | 7/1967 | Lawson | 66/170 |
| 3,470,928 A | * | 10/1969 | Schwartz | 139/420 R |
| 3,810,810 A | | 5/1974 | Bylund et al. | |
| 5,069,735 A | | 12/1991 | Reynolds | |
| 5,229,181 A | | 7/1993 | Daiber et al. | |
| 5,520,022 A | * | 5/1996 | Callaway | 66/194 |
| 5,594,970 A | * | 1/1997 | Benge | 66/170 |
| 5,667,612 A | * | 9/1997 | Benge | 156/290 |

FOREIGN PATENT DOCUMENTS

| | | |
|---|---|---|
| EP | 0 336 661 | 10/1989 |
| GB | 1088861 | 10/1967 |
| JP | 49 108263 | 9/1974 |
| JP | 59 70667 | 5/1984 |
| JP | 61 148252 | 9/1986 |
| JP | 61 190968 | 11/1986 |
| JP | 1 62384 | 4/1989 |
| JP | 2 45017 | 2/1990 |
| JP | 4 146300 | 5/1992 |
| JP | 4 102955 | 9/1992 |
| JP | 7 118928 | 9/1995 |
| JP | 8 188922 | 7/1996 |
| JP | 3030414 | 11/1996 |
| JP | 9 119067 | 5/1997 |

* cited by examiner

*Primary Examiner*—Danny Worrell
(74) *Attorney, Agent, or Firm*—Finnegan, Henderson, Farabow, Garrett, & Dunner, L.L.P.

(57) ABSTRACT

A lint-free wiper of the present invention is formed of a fabric containing no cut face in the structure thereof which may cause the generation of lint and fiber fall-off. Accordingly, the wiper can be used in a high-grade clean room of at least Class 100 without fear of dust generation. Since the dust-generation suppressing function is based on the fabric end structure formed of yarn loops, the wiper can be produced while eliminating fusion-bonding or an adhesion treatment of the cut face of the fabric. Therefore, the lint-free wiper can be composed of any materials including non-thermoplastic cellulosic fibers or others.

16 Claims, 8 Drawing Sheets

LINT-FREE WIPER

TECHNICAL FIELD

The present invention relates to highly lint-free wipers, particularly to lint-free wipers which are often used in clean rooms or production processes of precision instrumental parts or electronics parts including, typically, LSIs, or production processes of pharmaceuticals or medical instruments, which environment must be controlled to be free from fine dust, fibrous waste or the like.

PRIOR ART

Articles used in a clean room or a room in which the environment is controlled are required to have special performances necessary for maintaining the environment. In particular, the articles are required to hardly generate fine dust, fine debris of material or others (hereinafter referred to as lint). As is well known, contaminants or lint brought in the clean room are often derived from the operators themselves and articles used thereby. Accordingly, a special attention has been paid to articles such as working clothes or wipers and the improvement thereof has continued.

One of the potential sources of contamination with fineparticles in a clean room is a wiper for a daily wiping operation carried out therein. For example, wipers have been used for wiping up stains in the operation steps of producing or assembling semiconductors or integrated circuits. Also, wipers have been widely used for cleaning surfaces of various apparatuses or fixtures and cleaning inner walls or interiors of rooms. Since the wiper of this kind must be excellent in liquid absorption property and flexibility, it has become a structural obstacle for preventing fine particles or fibrous waste from being released and dispersed in the surrounding environment.

Materials for wipers used in clean rooms are discriminatingly selected in accordance with the degrees of cleanness required for the particular room from a group of a knitted fabric, a woven fabric, a non-woven fabric, sponge, paper or others. In a room where a high degree of cleanness is required, a knitted fabric or a woven fabric composed of synthetic fiber is particularly often used. In a room, where a relatively low degree of cleanness is required, a non-woven fabric mainly composed of cellulosic fiber is often used.

Generally speaking, a wiper used in a clean room is usually formed of a flat cut piece of a knitted fabric, a woven fabric or a non-woven fabric having a rectangular shape or others. In the wiper of this kind, edges of the wiper coincide with cut edges of the fabric. Since the wiper has such a structure, the edge portion and the end surface thereof are often fused to be of a film-like structure or are heat-sealed.

On the other hand, as fibrous material for constituting a wiper-forming fabric, fibers made of thermoplastic polymer, especially multi-filamentary yarns have been usually used. This is because, if a knitted fabric or others composed of such yarns is cut by a heat cutter or an ultrasonic wave cutter, the single filaments thus cut easily fuse and adhere, and hardly separate from the fabric whereby the generation of dust from the cut face is suppressed. Thus, there is a limitation in that non-thermoplastic or non-melting fibers such as cellulosic fibers are difficult to use for this purpose.

While polyester fibers are often used as the thermoplastic synthetic fibers for the wiper, they are poor in water-absorption property and, if a hydrophilic treatment is applied to the wiper, there is a risk of the increase in elution of a treatment agent when it is used for the wiping operation with an organic solvent.

Therefore, care must be taken in accordance with the conditions under which the wiper is used.

On the other hand, cellulosic fibers are excellent in water-absorption property, have less eluate, and are durable in use at a high temperature. However, they are not thermoplastic and, therefore, it is impossible to prevent the generation of dust and the release of fiber debris from the cut end face of the fabric.

Various methods have heretofore been proposed to decrease the amount of potential lint of wipers used in clean rooms required to have a high degree of cleanness. For example, in Japanese unexamined Patent Publication (Kokai) No. 2-45017 (Texwipe), a sheet composed of a thermoplastic fabric material is cut to have a given size, and a fused edge of thermoplastic fiber is provided at the periphery of the sheet, thereby preventing lint from being generated from the periphery of the cut faces or edges of the fabric. Since merely heat cutting the cut faces is not sufficient for suppressing the generation of lint, it is attempted that the generation of lint is reduced by fusion-bonding the thermoplastic fibers along the cut edge of the sheet over a given width. The sealed portion of the edge becomes film-like because the thermoplastic fibers are fused with heat and solidified again. Since the orientation and crystallization of the resin in this portion is insufficient, the tear strength and tensile strength thereof are deteriorated. Accordingly, it is necessary to increase the width of the fusion-bonded portion so that the fabric is not broken. For the above-mentioned reason, the wiper has a hard edge and is poor in flexibility and ease of handling. That is, since four corners are pointed, if the wiper is used for wiping a softer article, care must be taken not to damage the same. The above-mentioned problem regarding the edge is not solved even if a wiper is of a structure in which a material excellent in liquid absorption property is inserted into the interior of the sheet-like material.

The U.S. Pat. No. 5,069,735 (Milliken) proposes a method for cutting a wiping cloth of a predetermined size from a knitted fabric by using hot air or laser beam. According ito this method, it is possible to suppress the-release of lint by heat-fusing thermoplastic fibers situated at the edge along the periphery of the sheet. However, this method fails to prevent the edge from becoming film-like, and the problem of generation of lint and deterioration of physical properties such as a tear strength is still unsolved.

The U.S. Pat. No. 3,810,810 and British Patent No. 1,088,861 (Milliken) propose methods similar to that proposed by the above-mentioned Japanese Unexamined Patent Publication (Kokai) No. 2-45017 wherein a sheet is cut and the edge is sealed by using a hot roller or the like.

The U.S. Pat. No. 5,229,181 (Amber Technologies) discloses a wiper having a bag-like form prepared by heat-cutting a continuous tubular knitted fabric in the direction transverse to the longitudinal direction. The wiper of a bag-like structure has two edges of a continuous stitch structure and the other two edges which are cut while being thermocompression-bonded to melt the end portions of the cut fibers for the purpose of preventing lint from being released from the cut portion. Accordingly, there are problems common to those of the wipers proposed by the U.S. Pat. Nos. 5,069,785, 3,810,810, Japanese Unexamined Patent Publication No. 2-45017 or others. In this regard, a sheet-like wiper is also proposed which is prepared by partially fusion-bonding a knitted fabric in a bag-like form with an embossing roll. This wiper has a lower liquid-absorption property but is improved in dimensional stability and mechanical properties because of its single-sheet form.

All the wipers in the prior art described above can achieve the object of decreasing the generation of lint and detached fiber debris in a static state thereof. However, the wipers have been unsatisfactory for reducing the generation of dust and the release of fiber in the situation of practical use (when the wipers are subjected to stress such as stretching, creasing or scuffing or thereafter). Moreover, the wipers have not sufficiently had other required functions, for example, a water-absorption property, elution property in water and organic solvents, and ease of handling and safety thereof during the actual process and operation of the user. In addition, all the wiper must be prepared by cutting a knitted fabric accompanied with the cutting of loops of yarns forming the knitted fabric. As a result, the yarns have numerous cut points of fibers therein, and a special treatment is required for preventing lint and detached fiber debris of cut segments of fibers from being released from the cut faces. Since the fusion bonding is employed for preventing the release of fiber debris and sealing lint at the cut face of the knitted fabric, use of thermoplastic fiber or composite fiber containing the same is substantially necessary. This means that cellulosic fiber is substantially excluded from being used as-a material for a wiper, which is one of the optimum materials in view of the liquid-absorption property, resistance to solvent, and the small amount of elution component. When the sealed portion is made as small as possible in the fusion-bonding process for enhancing the ease of handling during the use, fine fiber segments are liable to be released, resulted in an unsatisfactory suppression of dust generation.

SUMMARY OF THE INVENTION

An object of the present invention is to provide a wiper composed of a fibrous fabric having a very low dust-generation property usable in a clean room.

Another object of the present invention is to provide a lint-free wiper usable in a clean room of a high degree of cleanness of at least Class 100.

A further object of the present invention is to provide a technology capable of providing a lint-free wiper composed of fiber material by a simple means, which wiper assuredly satisfies a performance optionally required at any stage of used.

According to the present invention, in a wiper composed of a fibrous fabric, cut ends of fibers present in a wiper, which are a cause of dust generation, are successfully reduced by forming the periphery of the fabric substantially with loops of yarns forming the fabric.

In other words, according to the present invention, a lint free wiper is provided, wherein the edge of a fabric is substantially composed of loops of yarns forming the fabric.

The wiper of the present invention is of a flat, cylindrical or bag-like shaped structure wherein all surfaces extending from a wiping surface in a central region of a flat surface to the periphery thereof are formed of a fabric.

The fabric includes a woven fabric and a knitted fabric. In this connection, to achieve the object of the present invention, the woven fabric includes those obtained from a loom capable of continuously inserting a weft yarn, such as a fly loom or a shuttle loom, and the knitted fabric includes a warp knit fabric, a weft knit fabric, a circular knit fabric or others.

Upon the production of the lint-free wiper of the present invention-having the structure described above, the knit fabric can be formed as a fabric structure having the periphery substantially formed of loops of knitted yarn alone. That is, the wiper is obtainable while completely excluding the formation of cut faces due to the use of a blade or the like. Thereby, the knit fabric is particularly suitable for the present invention from the technical and commercial view points, as will be apparent from the aspects and examples of the present invention described later.

The present invention will be described below in more detail with reference to the attached drawings.

According to the present invention, a lint-free wiper is formed substantially of a fabric alone. The edge of the fabric forming the wiper may correspond to that of the lint-free wiper or may be disposed on a central wiping surface or a back surface of the wiper.

In the present invention, the edge of the fabric refers to the periphery of the fabric when it is unfolded without breaking the fabric structure. That is, if the fabric is a woven fabric, the edge stands for that extending in the weft or warp direction, while if the fabric is a knitted fabric, it stands for that extending in the course or wale direction.

According to the present invention, it is necessary that the edge of the fabric, as defined above, is substantially formed of loops of yarns constituting the fabric. A loop of a yarn constituting the fabric refers to a state wherein a passage of the yarn constituting the woven or knitted fabric while being arranged in the lengthwise direction changes its direction by 90 degrees or more at the edge of the fabric toward the fabric surface.

Figure 1A:
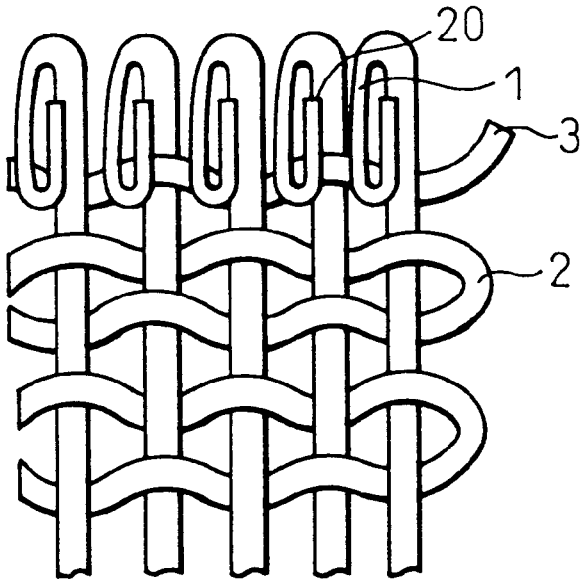
FIGS. 1A and 1B are explanatory views showing examples of a wiper formed of a woven fabric according to the present invention.
Figure 1B:
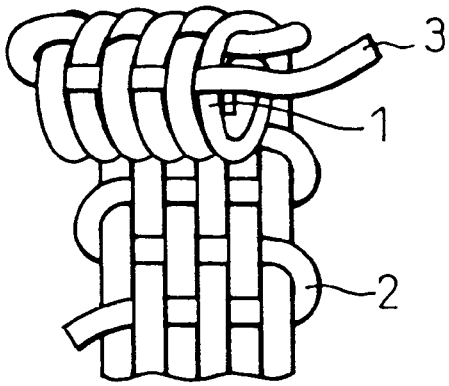

For example, when a body of a lint-free wiper is formed of a woven fabric, the fabric woven by a shuttle loom or a fly loom has an edge consisting of loops formed of edge portions of weft yarns (2) as shown in FIGS. 1A and 1B. This fabric can constitute a lint-free wiper according to the present invention by forming the periphery with a group of loops which are formed by bending the cut segments (20) of warp yarns (1) to the fabric side (the loops may be fixed to the fabric structure by the sewing after the loops have been formed). In this woven fabric, there are no cut ends, of yarns constituting the fabric, in the periphery thereof.

Figure 2:
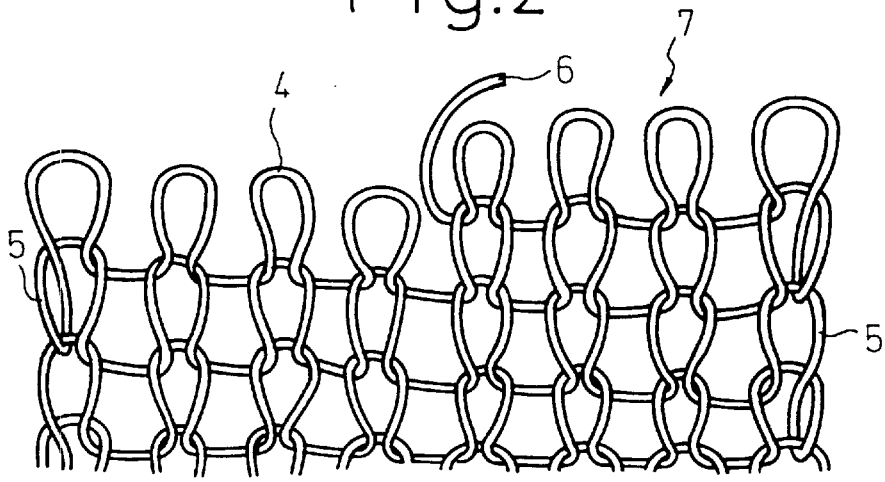
FIG. 2 is an explanatory view of the edge structure of a wiper formed of a knitted fabric according to the present invention.

On the other hand, when a lint-free wiper is constituted by a knitted fabric, a flat knitted fabric (for example, shown in FIG. 3A) is knitted by a flat knitting machine with a yarn (7) illustrated in FIG. 2, wherein an edge extending in the course direction is formed of loops (4), and another edge extending in the wale direction is formed of loops (5). Thus, there are no cut ends, caused by a blade or others, at the periphery of the knitted fabric.

As described above, it its important for the edge of the fabric structure constituting a body of the lint-free wiper according to the present invention to be substantially formed of loops. However, the inclusion of cut ends of warp yarns or yarns introduced during the constitution of the fabric structure, i.e., during the weaving operation or the knitting operation, is not excluded from the edge portion of the fabric structure thus identified. For example, part of cut segment ends (20) of warps or cut segment ends (3) of weft yarns may be contained in the edge as shown in FIG. 1A or, some cut segment ends (6) of yarns (7) constituting a knitted fabric illustrated in FIGS. 2A, 3A and 3B may be contained in the edge.

The allowable number of cut ends of this kind is approximately less than twice the number of yarns constituting the fabric structure; in other words, the existence of cut ends on the respective ends of the yarns is permissible. For example, for a woven fabric, cut ends of warp yarns constituting the fabric structure or part thereof forming loops may be contained in the edge portion, or an extremely small number of cut ends of weft yarns constituting the fabric may be contained in the edge portion. On the other hand, for a knitted fabric, a starting end and a final end of a yarn constituting the knitted fabric may be contained in the edge portion.

The lint-free wiper of the present invention does not contain any cut lines at the edge of the fabric forming the wiper, but the edge of the fabric structure is formed of loops of yarns constituting the fabric. There are basically no cut ends of yarns in the edge portion of the fabric structure. Consequently, the generation of dust by, and the release of lint from, the wiper are remarkably reduced.

A fabric having a certain area is provided for forming the wiper. To industrially produce the fabric for the wiper, it is a common method that the fabric is prepared as a continuous large sheet and cut to be pieces of a predetermined size. Accordingly, the edge of the respective piece is formed with a cut line of yarns or loops. When the fabric is cut, yarns constituting the fabric are also cut. For example, if the fabric is a woven fabric, warp yarns and weft yarns are cut, and if the fabric is a knitted fabric, yarn loops are cut. Therefore, even though the fabric is formed of filamentary yarns, numerous cut faces of yarns are formed when the fabric is cut with a blade or others to generate a large amount of extremely short fibers or lint therefrom simultaneously, with the abrasion thereof with the blade.

According to the lint-free wiper of the present invention, the edge of the fabric is formed of loops and does not contain any cut lines. Yarns forming the fabric, for example, a knitted fabric, are cut at the start-course and the stop-course. In this case, the yarns are directly cut one by one, which is significantly different from a case wherein the fabric is cut as a whole. That is, when the yarns are individually cut, it is industrially possible to cut them at a large angle (e.g., in the vertical direction) with respect to the lengthwise direction of the yarn, whereas it is difficult to cut them at a large angle when the fabric is cut as a whole. In particular, when a knitted fabric formed of loops is cut, it is practically impossible to industrially cut all the yarns at a large angle with respect to the lengthwise direction of the respective yarns. Accordingly, not only an increase in the number of cut portions but also an increase in the possibility of physical damage to the fiber itself is not avoidable.

There is the same tendency when heat cutting or laser cutting is adopted as in cutting with a blade. Accordingly, by forming the edge of the fabric with loops, it is possible to reduce the generation of dust or fiber debris to a great extent in comparison with the case wherein the edge of the fabric is cut. Since a lint-free wiper is formed of a fabric having no cut lines at the edge thereof, the heat treatment of the cut lines in the edge portion of the fabric is unnecessary, whereby the production process can be shortened, and causes of the contamination in a subsequent process such as the generation of fine lint or dust or the release of fiber debris can be minimized.

In particular, since it is possible to adopt non-thermoplastic fiber material such as cellulosic fiber, the water-absorbency and the ease of handling can be significantly improved.

Also, the user is free from the anxiety of the generation of a large amount of lint during the practical use due to the breakage of a heat-sealed portion.

A wiper according to the present invention formed of a flat, bag-like shaped, tubular structure with closed end or cylindrically shaped knitted fabric prepared by a flat knitting machine or a circular knitting machine, in particular, that formed of a cylindrically shaped knitted fabric wiper which has preferably a hollow structure has a wiper shape as it is knitted without the necessity of special edge treatment, and therefore, can be produced with a high workability. Also, a degree of freedom in wiper design such as a selection of fiber material increases to a great extent.

The preparation of a wiper according to the present invention formed of a woven fabric or a warp knit fabric to be of a shape usually used, for example, a 30 cm×30 cm square, is more troublesome than in the above-mentioned one because the warp-wise directional edge must be treated. However, this type of wiper is suitably used when a wiper of a continuous length is needed, for example, in an automated cleaning system. This is because, in a situation wherein the wiper is used in a continuous manner, the edge of the wiper substantially exists in the weft-wise direction. Accordingly, the wiper of the present invention formed of a woven fabric or a warp knit fabric becomes a wiper of a continuous length having no cut lines cut with a blade.

BEST MODES FOR CARRYING OUT THE INVENTION

Yarns forming the fabric used for forming the lint-free wiper of the present invention may be spun yarns (those spun from staple fibers of 30 to 50 mm long are usually used), multi-filamentary yarns or composite yarns thereof.

When the yarn composed of staple fibers is used, to prevent individual fibers from being released from the yarn body, the yarn is preferably imparted with a large number of twists or covered with a multi-filamentary yarn to be a composite plied yarn. The multi-filamentary yarn is favorably used for composing at least a wiping surface of a -wiper. This is because even if a filament is broken when the actual wiping operation is carried out, it causes at most a fluff firmly rooted to the yarn body and seldom falls off therefrom. A wiper in which all the yarns constituting the fabric are filamentary yarns is most favorable because the risk of a release of individual fibers constituting the fabric becomes extremely small.

The types of fiber material used for a lint-free wiper according to the present invention may not be limited. Particularly, when a multi-filamentary yarn is used, a raw yarn, a false-twisted yarn, a twisted yarn, an air-jet interlaced yarn, a composite yarn or others may be adopted. Further, unless the achievement of the object of the present invention is affected, two kinds of fiber material or more, such as a combination of synthetic fiber and a regenerated cellulosic fiber, are mixedly interlaced, twisted or false-twisted (by, for example, a differential elongation false-twisting method).

The fiber material used for a lint-free wiper according to the present invention includes synthetic fiber such as polyester, polytrimethlene-terephthalate, polypropylene, polyamide, polyacrylonitrile or polyparaphenylene-terephthalamide; cellulosic fiber such as viscose rayon, cupra-ammonium rayon, cotton or ramies; and other fiber such as acetate fiber, proteinaceous fiber, silk or wool, which are properly selected in accordance with uses and/or solvents to be used.

The above-mentioned fiber material may not be purely composed of fiber-forming polymer or the like but may contain additives or oil usually used in a fiber production process, a sizing agent used in a weaving or knitting process, dye or a very small amount of decomposition product of polymer. There is no limitation in the production process, shape, micro-structure or crystal structure of the respective fiber material.

Since no cut line caused by a blade exists in the fabric according to the present invention, there is no risk of an increase in the generation of lint and the release of fiber debris even though non-thermoplastic fibers are solely adopted.

Thickness of a yarn used in the present invention may be properly selected in accordance with uses, conditions, or fabric production methods such as types of knitting machine. For example, if a flat wiper is produced by using a flat knitting machine, a yarn having a thickness in a range from 100 to 1000 dtex is preferably adopted. If the yarn thickness is smaller, a resultant wiper becomes coarser in structure, while if the yarn thickness is larger, the product is liable to be harder, whereby the yarn is preferably selected and/or designed while taking a liquid-absorption property and a wiping ability or the resultant wiper into account. When a cylindrically shaped wiper is produced by using a circular knitting machine, a suitable yarn has a thickness in a range from 5 to 400 dtex, preferably from 10 to 300 dtex, more preferably from 20 to 200 dtex. If the yarn thickness is less than 5 dtex, yarn breakage is liable to occur during the knitting operation, resulting in a risk of the generation of lint or the release of fiber debris from the broken end. Contrarily, if the yarn thickness exceeds 400 dtex, a basis weight of the resultant fabric becomes too large, whereby it is important the fabric is produced while properly selecting a kind or type of yarn and deciding a knitting design.

The thickness of an individual single filament constituting yarn used for the present invention may be suitably selected in accordance with uses and conditions of the resultant product. In general, the single filament thickness constituting a yarn is in a range from 0.05 to 5 dtex, preferably from 0.8 to 5 dtex. If the single filament thickness becomes larger, the resultant wiper is liable to be harsh. Contrarily, if the single filament having a smaller thickness is used, the resultant wiper becomes softer and is more excellent in wiping ability, but the tensile strength and the wearing strength are lowered, whereby the single filament thickness is preferably selected in accordance with objects and uses of the resultant wipers in a suitable manner. A mixture of single filaments having different single filament thickness may be used.

The form and cross-sectional shape of fiber material are not limited. That is, the form may be uniform or irregular in thickness in the lengthwise direction of the fiber, while the cross-sectional shape may be polygonal, multi-lobal, hollow or indefinite, including circular, L-shaped, Y-shaped, W-shaped, octa-lobal, flat and dog-bone shape.

In particular, if non-circular cross-sectional fibers of L-shape, Y-shaped, W-shaped, octa-lobal, flat or dog-bone shape are used, a total surface area of fibers preferably increases in comparison with that of the circular cross-sectional fiber of the same yarn thickness to enhance the liquid-retention capacity as well as the liquid-absorption capacity. Especially, "Technofine" having a W-shaped cross-sectional shape, marketed from Asahi Kasei K.K. is preferably used for the improvement in the liquid-absorption property and the wiping ability.

Cellulosic fibers are preferably contained in yarns constituting the fabric according to the present invention. In particular, 90% or more in an area ratio of a wiping surface in an ordinary use is preferably formed of cellulosic fibers because cellulosic fibers are highly resistant to solvent and largely contributes to the improvement in liquid-absorption property.

According to the present invention, yarns constituting the fabric are preferably composite yarns of cellulosic fibers and synthetic fibers, especially those consisting of cellulosic core fibers and synthetic sheath fibers. By using such a composite yarn, a knit fabric can be easily produced under less strict conditions by a simple apparatus, and the resultant wiper has favorable properties derived from the synthetic fiber and the cellulosic fiber.

The composite yarns used for the present invention may be obtained by any of conventional methods including, for example, an air-jet interlacing method using air vortex, a false-twisting method carried out after the air-jet interlacing, a covering method wherein sheath fibers are wound around core fibers, and a twisting method. Also, such methods may be properly selected in accordance with characteristics of the respective yarns for the purpose of imparting the structural features of core and sheath to the resultant yarn. In general, the covering method or the combined false-twisting method (differential elongation false-twisting method) is often adopted.

In the lint-free wiper according to the present invention, the shape of a fabric constituting a wiper body may be selected in accordance with the shape of the lint-free wiper.

Figure 4A:
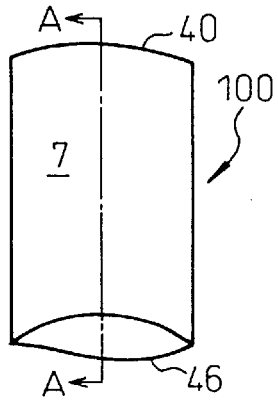
FIGS. 4A, 4B and 4F are perspective views showing examples of a wiper formed of a bag-like shaped knitted fabric according to the present invention.
Figure 4B:
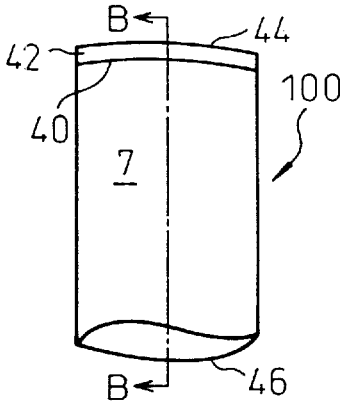
Figure 4F:
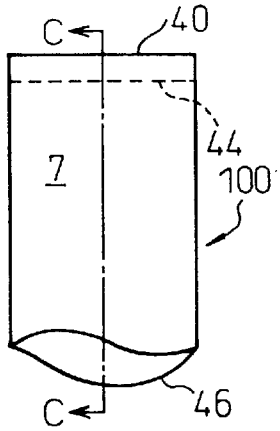
Figure 5A:
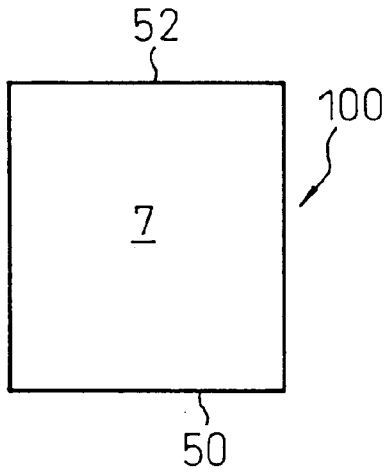
FIGS. 5A and 5B are explanatory views of wipers formed of a tubular with closed ends knitted fabric according to the present invention.
Figure 5C:
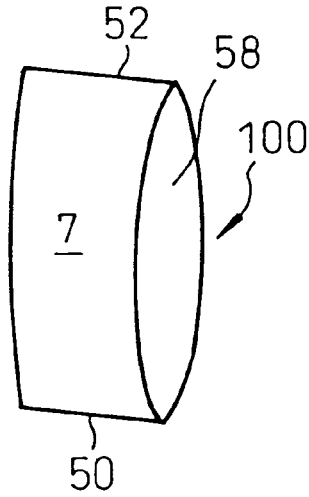
FIG. 5C is a perspective cross-sectional view for explaining FIG. 5A.
Figure 5B:
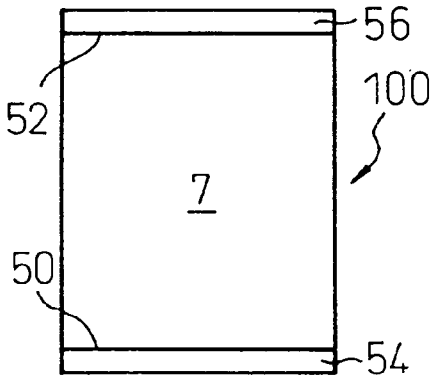

For example, the knitted fabric may be of a flat shape (see FIG. 3), a bag-like shape-(see FIGS. 4A, 4B and 4F) or a tubular structure with closed ends (see FIGS. 5A and 5B). Also, there are no limitations in knitting structures and loop sizes in the warp-wise and weft-wise direction providing the above shapes are satisfied. For example, to prevent the course directional end of a flat knitted fabric from being frayed, a ravelling cord stitch or a picot stitch may be adopted. A stitch structure formed by a stitch-transferring or narrowing or widening method may be used, or a linking may be adopted. To prevent a wale-directional end thereof from being frayed, a loop size may be made smaller to more densely knit the peripheral region rather than the central region. Further, a stitch structure difficult to be frayed may be adopted solely in the end region.

Such lint-free wipers may be manufactured by using a suitable knitting machine which is selected in accordance with their purposes. For example, when a lint-free wiper is prepared from a knitted fabric of a flat shape (FIG. 3), a bag-like shape (FIGS. 4A and 4B), a tubular structure with closed ends (FIGS. 5A and 5B) or a cylindrical shape (FIG. 6) flat knitting machine may be used. Alternatively, when a lint-free wiper is prepared from a knitted fabric of a cylindrical shape (FIGS. 6A to 6C) or a cylindrical shape with a hollow portion(s) (FIGS. 7A, 7D, 8A and 9A), a circular knitting machine may be used.

The knitted fabric for forming the lint-free wiper according to the present invention is preferably of a cylindrical shape, because at least a wale-directional edge (60) has no cut loops but is formed of a body of the knitted fabric. This knitted fabric is obtained without cutting the fabric itself during the formation thereof. That is, a yarn is cut solely at a starting end (62) and at a tail end (64) so that the course-directional ends (62) and (64) are in a loop state. In this state, fibers in the lint-free wiper are seldom damaged because the loops have not been cut, and the generation of dust or the release of lint is suppressed. Even though a yarn is frayed from the end portion of the fabric, it only releases the loop from the stitch structure, and does not break the same. Accordingly, such a phenomenon causes no problem in the achievement of the object of the present invention for minimizing the generation of dust or lint, although the fabric might be somewhat deformed.

It is possible to adjust a length of the cylindrical knitted fabric by increasing or decreasing the number of knitted stitches or varying a loop size.

Figure 6A:
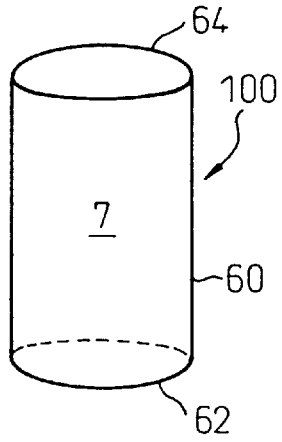
FIG. 6A is an explanatory view of one example of a wiper formed of a cylindrically shaped knitted fabric according to the present invention.
Figure 6B:
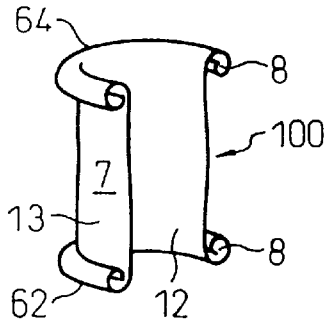
FIGS. 6B and 6C are perspective cross-sectional views explaining FIG. 6A.
Figure 6C:
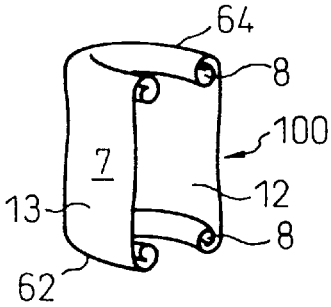

Preferably, an end portion, for example, 62 or 64 in FIG. 6A of the fabric wherein the yarns are cut at a starting stage or a finishing stage of the knitting operation is curled (8) so that cut ends of the yarns are not exposed above the outer surface of the lint-free wiper (see FIGS. 6B and 6C). The curling also serves to prevent the occurrence of fraying from this portion. A length of the curled portion as measured in the course direction is preferably in arrange from about 3 to 10 mm. When the fabric is formed of thermoplastic synthetic fibers, the curled portion may be directly press-bonded to a body of the wiper through a thermal treatment such as a hot-embossing. The latter case is favorable because the yarn end is furthermore prevented from being frayed. Also, the end portion of the knitted fabric may be sewn to a body thereof to prevent the yarn from being frayed therefrom. Thus, the fabric is capable of being repeatedly used.

A lint-free wiper of the present invention is furthermore preferably formed of a cylindrically shaped knitted fabric including a cylindrical hollow structural portion (9) (see FIGS. 7B, 7C and 7E) and a single-plied structure (10) connected to the hollow structural portion (9). According to this structure, loops are naturally provided in the course-directional end (for example, 72, 74 in FIG. 7) of the fabric as part of a body of a knitted fabric (7), which loops are necessary when the fabric is used as a wiper and, if none, must be specially formed, for example, in warp yarns of a woven fabric.

In many cases, the above-mentioned single-layer structure (10) is formed at the tail-end portion of the knitted fabric, and provides resistance against the fraying of the hollow structural portion (9). Even if the fraying occurs, there is no problem in the achievement of the object of the present invention, because the cylindrical knitted fabric structure is still maintained. However, it is desired to avoid such an inconvenience for the purpose of maintaining the above-mentioned structure which is one of the favorable aspects of the present invention. Accordingly, another single-plied structure (10) is added to a connecting portion (14) of the hollow structural portion (9) so that a cut segment of a yarn constituting the knitted fabric (7), that is, a cut end of a stop-course yarn is present outside the connecting portion (14). Thereby, the hollow structural portion, is resistant to the fraying even if the cut end yarn is pulled during the handling thereof in the post treatment after being knitted (such as rinsing, drying, packaging or the like).

According to the present invention, the single-plied structure (10) is preferably located at the edge (74) (FIGS. 7B and 7C) or inside (12,) (FIGS. 7E, 8B, 8C and 9B) of the cylindrically shaped knitted fabric. This arrangement is effective for isolating the single-plied structure (10) having a cut end of yarn constituting the course end of the knitted fabric from a wiper body so that a wiper having no cut end of yarn present on the outer surface thereof is obtainable. Such a wiper is free from particles and fibers released therefrom when the wiper is used, because a cut end of yarn does not exist on an outer surface of the cylindrically shaped knitted fabric constituting a wiping surface (13) and, also, it is difficult to fray.

Figure 7A:
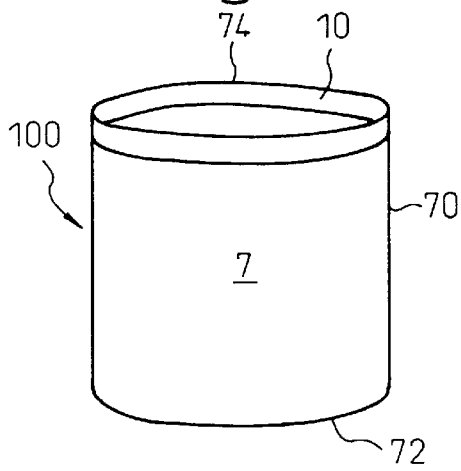
FIGS. 7A and 7D are explanatory views showing examples of a wiper formed of a cylindrical knitted fabric having a hollow structure according to the present invention.
Figure 7B:
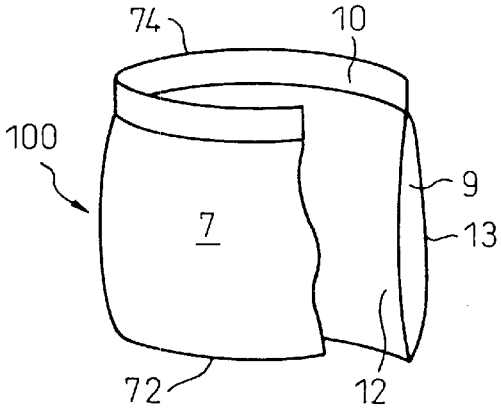
FIGS. 7B and 7C are perspective cross-sectional views for explaining FIG. 7A.
Figure 7D:
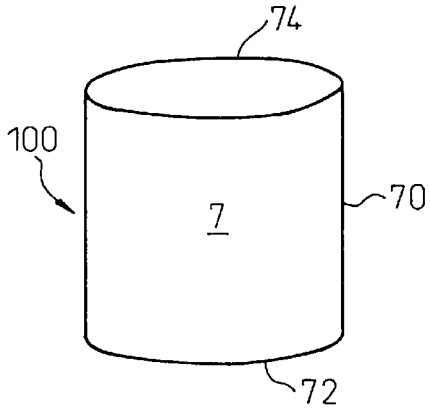
Figure 7C:
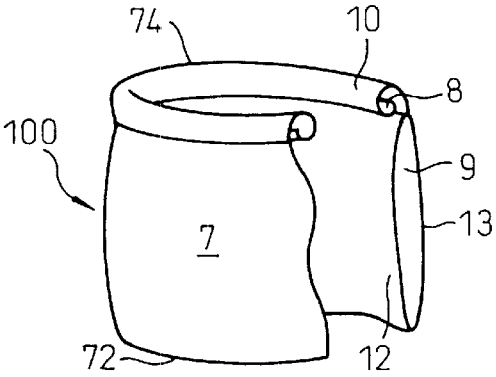
Figure 7E:
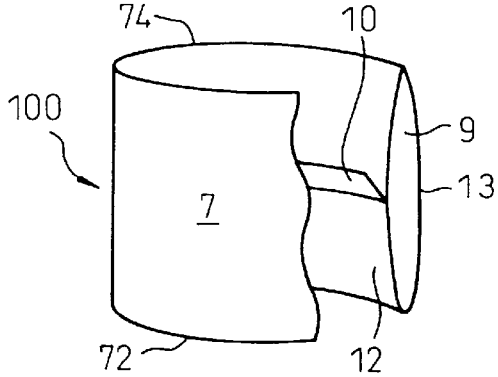
FIG. 7E is a perspective cross-sectional view for explaining FIG. 7D.

For example, as shown in FIG. 7E, after the cylindrically shaped knitted fabric has been completed, the single-plied structure (10) is preferably displaced to the inner wall (12) by endlessly rotating inner and outer walls constituting the hollow structural portion (9). This effectively prevents the end yarn from being frayed and particles or fibers from being released. Since a gentle convex shape sis formed when the wiper is used, the operability thereof is facilitated. Even though the single-plied structure exists at the extremity (74) of the cylindrically shaped knitted fabric, the former is preferably curled (8) to prevent the yarn end from being exposed (see FIG. 7C).

The extremity of the knitted fabric is favorably curled (8).

In this text, a term "curl" stands for a phenomenon wherein an end of a knitted fabric is rolled up toward a center region thereof when the fabric is stationarily placed on a flat place. While there are no limitations in a roll-up angle or the number of turns, the number of turns is preferably in a range from 1 to 5 at the extremity of the knitted fabric. If the number of turns or the roll-up angle is excessively small, the yarn end is not effectively concealed. On the contrary, if the number of turns is excessively large, the curled portion becomes too thick to be easily handled. Therefore, the degree of curling is preferably selected in accordance with the uses and/or characteristics necessary for the wiper. Also, it is possible to vary yarns constituting the extremity of the knitted fabric or stitch structures to facilitate the curl.

According to the present invention, the cylindrically shaped knitted fabric preferably has a plurality of cylindrical hollow structural portions (9-1), (9-2), - - - (9-m), - - - (9-n) (see FIGS. 8B, 8C and 9), each of which is connected to the adjacent one via a single-plied structural connecting portion (14), (14-1), - - -, (14-m), - - - (14-n). According to this arrangement, the starting end and-the tail end of the knitted fabric are necessarily present on the inner side (12) of the cylindrically shaped knitted fabric, not on the outer side (13) usually used as a wiping surface when used as a wiper, whereby it is possible to avoid the excessive load or abrasion being applied to the cut end of yarn present at the starting end and the tail end of the knitted fabric by the wiping operation.

The number of hollow structural portions (9) may be selected in accordance with the uses of the wiper. For example, when a wiper of a large size or having a high liquid-absorption capacity is required, the number of hollow structural portions (9) is favorably increased (see FIG. 9). If the wiper is used for a manual, wiping operation, a wiper having two hollow structural portions is sufficient (see FIG. 8), which is simple in structure and easy to produce.

The size (length and width) of the respective hollow structural portion (9) may be optionally selected in accordance with the conditions under which the wiper is used. For example, when the wiper having two hollow structural portions (9-1 and 9-2 in FIG. 8) is sequentially knitted, the lengths of the respective hollow structural portion are preferably selected to be substantially equal to the other, because the finishing part is positioned in a middle area of the inner side of the wiper so that the risk of fraying of the knitted fabric is reduced. Usually, a length of the hollow structural portion (9) is preferably selected to be slightly smaller than half a length of the wiper. Alternatively, if a wiper having a relatively small basis weight is desired, the length of the hollow structural portion is preferably reduced, while the length of the single-plied structural connecting portion (14, a portion for connecting two hollow structural portions (9) to each other) is preferably increased. If each of the hollow structural portions (9) has a size corresponding to that of a usually used wiper, the resultant wiper is of a structure wherein two wipers are coupled to each other, which is advantageous when used for wiping a large amount of liquid. In this regard, a circumferential length of the hollow structural portion (approximately ½ thereof be a width of a wiper) is preferably determined to be matched with a knitting width of a flat knitting machine, or to a cylinder diameter of a circular knitting machine because of the ease of setting of the knitting machine and the design of the fabric.

According to the present invention, a single-plied structure (10) is preferably connected to a boundary between the hollow structural portion (9) at the extremity of the cylindrically shaped knitted fabric and the single-plied connecting portion (14) connected thereto (see FIG. 8). According to this arrangement, the hollow structural portion (9) is prevented from being frayed. Thus, the single-plied structure (10) having a stop-course becomes free from a load imparted when the wiping operation is carried out. A length of the single-plied structure (10) is preferably selected with reference to a degree of curling. Also, a circumferential length of the single-plied connecting portion (14) is preferably selected to be substantially equal to that of the hollow structure (9) although it may vary in accordance with types of yarn and/or designs of fabric.

The hollow structural portion (9), the single-plied structure (10) and/or the connecting portion (14) are preferably formed as a continuously knitted fabric for the purpose of eliminating th,e operation for coupling them to each other. Such a cylindrically shaped knitted fabric could be produced by using a flat knitting machine or a circular knitting machine having a bed width or a cylinder diameter corresponding to a required size of a wiper.

Preferably, the fabric used for producing the lint-free wiper according to the present invention is of substantially of a double-layer structure. For a knitted fabric, the double-layer structure preferably has inner and outer layers easily distinguishable from each other. Such a structure is, for example, of a flat shape, a bag-like shape, a tubular structure with closed ends and cylindrical shape. According to the double-layer structure, it is possible to more easily design suitable knitted fabrics in which the inner and outer layers, respectively, have different functions from each other, and to obtain favorable lint-free wipers matching with the condition under which the wipers are used. In this regard, "the knitted fabric of substantially a double-layer structure" means that the knitted fabric should not be limited to those in which front and back surfaces are formed of two separate knitted fabric layers, respectively, or are strictly defined by the difference in structure and/or material, but includes those in which an apparent fiber-composition ratio is made to change between the front and back surfaces of the knitted fabric by adopting a so-called plating method or others. For example, when a plurality of kinds of materials are used, the knitted fabric includes not only those having the apparent fiber-composition ratio of 100% with respect to specific fibers on the respective surfaces but also those in which the respective surfaces have apparent composition ratios different from each other. When a wiper in which fiber materials are different between front and back surfaces is formed with a knitted fabric composed of two kinds of yarns or more by a plating method or the like, the front surface is preferably formed of synthetic fibers having a high resistance to wear and a high mechanical strength, while the back surface is preferably formed of fibers excellent in liquid-absorption property, such as regenerated cellulosic fibers. By this arrangement, it is possible to use fiber materials having a relatively low resistance to wear or abrasion.

By adopting the double-layer structure, it is possible to easily improve the mechanical strength of the knitted fabric and impart various functions to the wiper. For example, in a wiper substantially having hydrophobic fibers on the outer surface and hydrophilic fibers on the inner surface, a liquid is liable to pass through the hydrophobic fiber layer when the wiping operation is carried out and is retained in the hydrophilic fiber layer so that the return of liquid to the surface to be wiped is inhibited. As the hydrophobic fibers, synthetic fibers such as polyester fibers are preferably used, while as the hydrophilic fibers, cellulosic fibers are preferably used. In such a case, although the cellulosic fiber is inferior in mechanical strength, it is effectively reinforced with the synthetic fiber. If a multi-filamentary yarn is used in the outer layer of the double-layer structure and a spun yarn composed of staple fibers is used in the inner layer, the exposure of fluff and/or yarn ends is avoidable to minimize the falling-off fibers, and also the bulkiness and liquid-absorption capacity is facilitated.

In a case of a wiper having a shape shown in FIGS. 7 and 8, the double-layer structure is preferably a cylindrical knitted fabric provided with hollow structural portion(s) (9). In general, the hollow structural portion (9) constitutes a substantial wiping section when the fabric is used as a wiper and the wiping performance of the hollow structural portion substantially represents that of the wiper. As means for forming the double-layer structure, a plating method is preferably used because of its simplicity.

If the condition under which the wiper is used allows, the above-mentioned double-layer structure may be properly provided. For example, to lower the basis weight, the fabric of the present invention may be produced to have two shorter hollow structural portions (9) and one longer single-plied connecting portion (14). In this fabric, a portion substantially used for the wiping operation is the single-plied connecting portion (14), the wiping performance of which is almost determined by that of this portion. As means for knitting the double-layer structure, a plating method is preferably used because of its simplicity.

According to the present invention, at least one part of the inner layer of the double-layer structure is preferably composed substantially of cellulosic fibers, because the cellulosic fibers inferior in mechanical strength and resistance to wear or abrasion are concealed to be protected by synthetic fibers, while facilitating the water-absorption property of the former. If the cellulosic fibers are contained even in part of the fabric, it is possible to maintain a sufficient liquid-absorption property. Also, since the amount of cellulosic fiber are expensive in comparison with synthetic fibers, can be reduced, this arrangement is favorable on an industrial view point. If the outer layer is formed of synthetic fibers, one part of the inner layer is of cellulosic fibers, and another part thereof is of electro-conductive fibers, it is possible to obtain a high-performance wiper excellent in wiping capacity, liquid-absorption ability and electro-conductivity.

In the present invention, synthetic fibers constituting the outer layer of the double-layer structure preferably have a single filament thickness constituting a yarn in a range from 0.05 to 2.0 dtex. The synthetic fibers having such a thickness facilitate the wiping capacity and the softness of the resultant wiper. The mechanical strength of the wiper using the synthetic fibers of such a thickness is sufficient for ordinary use.

Preferably, the synthetic fiber constituting the outer layer, of the double-layer structure is substantially of a non-circular cross-sectional shape. By suitably selecting the non-circular cross-sectional shape in accordance with the uses and functions required for the resultant product, it is possible to impart special functions thereto. Also, by using yarns having other functions for constituting the inner layer of the double-layer structure, it is possible to impart combined functions thereto. For example, if "Technofine" fibers having a W-shaped cross-section, marketed by Asahi Kasei K.K. are used for the outer layer, the liquid-absorption capacity is improved to a great extent.

According to the present invention, at least part of the inner layer of the double-layer structure is preferably composed of electro-conductive fibers.

As described hereinbefore, the generation of dust or lint from a wiper is absolutely prohibited in conventional production process for LSIs or other electronic components, and there are also many processes wherein the generation of static electricity is absolutely prohibited. To eliminate such inconvenience, various electro-conductive fibers are used. Since a fabric composed of the electro-conductive fibers or containing the same as part thereof is cut to provide the conventional wiper, there is a risk not only of the generation of dust or lint bunt also of direct contact or contamination of LSI or other electronic component with electro-conductive fibers exposed on the surface.

When the electro-conductive fibers are used for constituting at least part of the inner layer of the knitted fabric having a double-layer structure according to the present invention, a probability of the direct contact or contamination of the electronic component with electro-conductive material is minimized, while removing static electricity, whereby the resultant wiper is free from the generation of dust or lint and excellent in electro-conductive performance.

Any kinds of electro-conductive fibers may be used, including those containing carbon, those plated or metalized with metal such as gold, silver, copper or others, or composite yarns of metallic fibers of 10 to 1000 $\mu$m thick made, for example, of gold, silver, copper, molybdenum, nickel or others mixed with fibers of other material such as synthetic fibers, which are properly selected in accordance with uses.

Since the electro-conductive fibers are used for satisfying various requirements in accordance with uses, there are various cases wherein substantially all of the inner layer of the double-layer structure or part thereof is composed of such fibers, or wiper may be, as a whole, composed of them.

In the present invention, a cylindrically shaped knitted fabric may be flatly folded and partially fixed through a hot embossing roll or with an adhesive to obtain a sheet-like configuration. In this case, the fixed portions are selected so that both of the start-course and stop-course region, of the cylindrical fabric are preferably folded inward. The sizes and the number of fixed portions are preferably selected not to deteriorate a hand feel and a liquid-absorption capacity. When an adhesive is, used, care must be taken as to what kind of eluate is generated by a solvent adopted in the process in which the wiper is used. To more enhance the liquid-absorption capacity, the resultant knitted fabric may be subjected to a treatment for facilitating the hydrophilic property thereof or synthetic fibers preliminarily subjected to such a treatment may be used for constituting the knitted fabric. In this case, care must be taken so that no eluate is generated and no decomposition occurs in accordance with uses or conditions.

According to the present invention, the size of the wiper and the basis weight of the sheet may be suitably designed depending upon the applications in which it is used. In many cases, in general, the size is in a range from 3×3 inches to 12×12 inches, and the basis weight is in a range from 100 to 200 g/m$^2$.

According to the present invention, the wiper is produced by initially preparing a fabric capable of achieving the object of the invention. After the fabric is washed to remove oil, it is rinsed in a clean room with ultra-pure water, dried,; and packed.

Since the wiper of the present invention is used in a clean room or in-a room in which the environment is controlled, it is important not only to suppress the generation of dust and lint from the fabric but also to remove various contaminants, dust, yarn debris or lint adhered to the fabric. The as-prepared fabric contains spinning oil attached to the yarn, oil transferred from a machine for preparing the fabric such as a knitting machine and dirt and stains adhered due to static electricity. Therefore, the fabric cannot be used as it is in a room in which the environment is controlled, such as a clean room. It is initially necessary to wash the fabric to remove oil or dirt. The washing operation for removing oil or dirt may be carried out in a clean room.

Usually, the washing operation for removing oil is carried out by, for example, adding a surfactant of nonionic/anionic type while gently agitating the fabric under the heated condition. In this process, it is important that no excessive physical stress is applied to the fabric. If the excessive stress is applied to the knitted fabric, it may be unraveled. After the washing, it is desired to carry out a rinsing operation with cold water or hot water several times. The purpose of the rinsing operation is to completely remove the surfactant or others from the fabric, which is added in the washing operation.

After the rinsing operation for removing oil or others has been completed, it is important to treat the fabric in a clean room. This is for the purpose of avoiding recontamination caused by the adsorption of dust or lint due to static electricity in the subsequent processes. Water used for the rinsing operation is preferably ultra-pure water. Also, in the case of rinsing with ultra-pure water, surfactants or others may be added. It is, however, important to carry out the rinsing so sufficiently that no surfactant or metallic ions remain in the wiper after rinsing. Preferably, the rinsing is repeated several times with cold water or hot water. Furthermore, the rinsing conditions are preferably selected so that no excessive physical stress is applied to the fabric from the standpoint of avoiding such defects as unraveling of the fabric.

After the rinsing with ultra-pure water has been completed, the fabric is dehydrated. This makes it possible to perform the drying in a shorter time period and is favorable from the standpoint of productivity.

The drying of the fabric should also be carried out in a clean room. For example, a dryer of a tumbler type may be adopted or a hang-drying method may be used. After drying, if necessary, the fabric may be set with steam or may be ironed to correct its shape.

The dried fabric must be packaged in a clean room. Preferably, a bag used for the packaging is made of material prepared not to generate dust therefrom and not to absorb dirt therein due to static electricity. On the view point of use, the wiper is preferably packaged by double-wall bag packaging using the above-mentioned packing material. This is desirable from the standpoint of not bringing dust and dirt into the clean room by sequentially opening the packages when the same are brought into the clean room in which the wiper is actually used.

Described below are methods for producing a lint-free wiper of the present invention.

(1) Production of lint-free wiper composed of woven fabric

When a body of the wiper of the present invention is a woven fabric, it can be produced, for example, by using a so-called shuttle type loom. The width of the loom may be suitably selected in accordance with the properties required for the product, i.e., depending upon the size of the wiper, properties of fiber material to be used, and the weave structure. In many cases, the width of the respective wiper is in a range from 4 to 16 inches.

The warp density of the woven fabric is determined roughly based on the density of reed, and the weft density is determined by the number of reciprocations of the shuttle per unit feeding amount of warp yarn. The weave density is not specifically limited but may be freely selected in accordance with yarn thicknesses, weave structures and purposes. For example, a tough plain weave fabric is obtainable when polyester multi-filamentary yarns of 56 dtex/36 f are used as warp yarns and polyester multi-filamentary yarns of 83 dtex/36 f are used as weft yarns at a reed density of 79 ends/inch and at a weft density of 80 ends/inch. The production of the wiper according to the present invention by a shuttle loom is as follows. Warp yarns necessary for obtaining a desired width of the wiper are prepared. Initially, the warp yarns are fed without inserting the weft yarn to form a loop portion at the beginning edge of the warp yarns. Thereafter, the shuttle is operated to pick the weft yarn to weave the fabric. At a moment at which the woven fabric of a predetermined length has been formed, the warp yarns are fed again without inserting the weft yarn to form another loop portion at the other edge of the warp yarns. A portion to which the warp yarns are solely fed is cut at a distance about 1 cm apart from a portion to which the weft yarn is picked. Then, the cut ends of the warp yarns are folded toward the fabric side so that the loops of warp yarns are formed while including the plain weave portion as shown in FIG. 1B. The loops of warp yarn may be fixed by the sewing for the purpose of preventing unraveling of warp yarns at the respective edges.

(2) Production of lint-free wiper composed of warp knitted fabric

The wiper of a warp knitted fabric can be produced by using a so-called warp knitting machine. For example, when the wiper is produced by using a tricot knitting machine, the width of the knitting machine is suitably selected in accordance with functions required for the resultant product, i.e., depending upon the size of the wiper, properties of fiber material to be used, and stitch structure. Usually, the width is in a range from 20 to 150 inches and the width per piece is preferably in a range from 4 to 16 inches in many cases. The gauge of the knitting machine, i.e., the number of needles per inch, is suitably selected in accordance with performances required for the product. In an ordinary tricot knitting machine, 12 to 40 gauges, preferably 24 to 40 gauges are often used. The stitch structure is not particularly limited but is suitably selected depending upon the properties required for the product and properties of the fiber material. In order to accomplish the object of the present invention, it is important that the edge in the wale direction is of a stitch structure formed of loops. For example, if the fabric is to be knitted by a half-tricot stitch structure, the number of back yarns may be increased to be larger by one than the number of front yarns, so that the edge is formed of loops in the wale direction. To obtain a wiper of the present invention from the knitted fabric of a half-tricot structure, front yarns and back yarns (the latter being more than the former by one) are arranged within a desired width. In the beginning, the yarns are fed without being knitted. Then, the yarns of a desired length are knitted together and, as in the beginning, the yarns are fed without being knitted. The front and back yarns are cut at a distance of about 1 cm from the knitted portion, and loops are formed in the course direction by the method similar to that for the warp yarns of the woven fabric. Thus, the warp knit wiper according to the present invention is produced.

(3) Production of lint-free wiper composed of flat knitted fabric

Figure 3A:
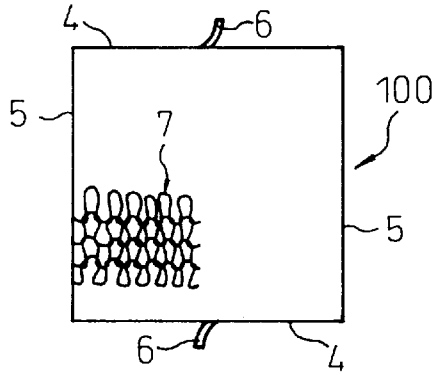
FIGS. 3A and 3B are explanatory views showing examples of a wiper formed of a flat knitted fabric according to the present invention.

FIGS. 3A and. 3B illustrate examples of lint-free wiper (100) of a flat fabric of a plain knit knitted with a single yarn fed through one yarn-feeding port. The edges of the knitted fabric in the course and wale directions are formed of loops alone, like that shown in FIG. 2, except for the cut end (6) of the stop-course yarn. FIG. 3A shows a lint-free wiper of a generally square shaped flat knitted fabric, and FIG. 3B shows that having two arcuate wale directional edges obtained by the increase and decrease in the number of stitches.

Figure 3B:
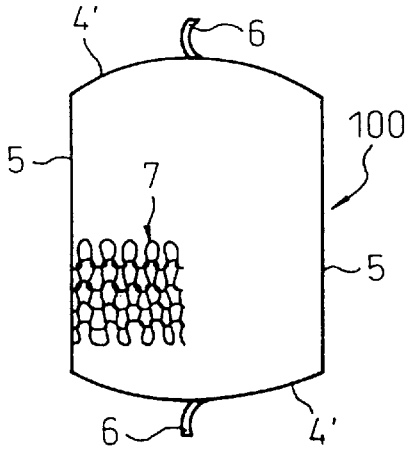

The lint-free wipers shown in FIGS. 3A and 3B can be produced by using, for example, a so-called flat knitting machine or preferable a full-fashion knitting machine. The width of the knitting machine is suitably selected depending upon the functions required for the product, i.e., depending upon the size of the wiper, properties of the fiber material to be used and a stitch structure. In many cases, the width is in a range from 2 to 150 inches and, preferably, the width per piece is in a range from 4 to 16 inches. The gauge of the knitting machine, i.e., the number of needles per inch, is suitably selected depending upon the performance required for the product. In an ordinary flat knitting machine, 2 to 26 gauges are adopted, and 8 to 22 gauges are preferably used. The smaller number of yarn-feeding ports for feeding yarn during the knitting operation is preferable for the purpose of achieving a reduction in falling-off fibers which is the object of the present invention.

The stitch structure may be constituted by the combination of knit, tuck and welt. Although there is no particular limitation, the start-course and the stop-course which are the course-directional ends are preferably knitted by a stitch structure which is difficult to unravel. For example, a ravelling cord knit (a bag-stop knit), a picot knit, a wind-stop knit, and shake-stop knit are desirable because the yarns are not easily unraveled. Further, the stitches may preferably be increased or decreased relying upon the widening or narrowing knit to suppress the unraveling. It is further desired that the end portion in the wale direction are knitted in a manner that the cannot be easily unraveled. In order to suppress the unraveling, furthermore, the size of the loop may be varied depending upon the central portion of-the knitted fabric and the ends. For example, the stitch may be decreased at the ends and may be increased in the central portion. When the double-layer structure is to be formed, specially designed yarn-feeding ports may be adopted or a special stitch structure may be employed.

(4) Production of lint-free wiper composed of bag-like shaped knitted fabric

Figure 4D:
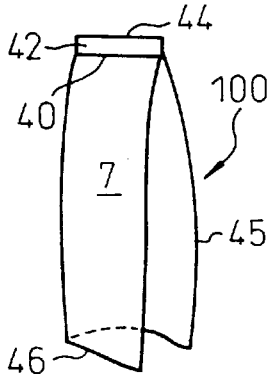
FIGS. 4D and 4E are perspective cross-sectional views for explaining FIGS. 4B and 4F.
Figure 4E:
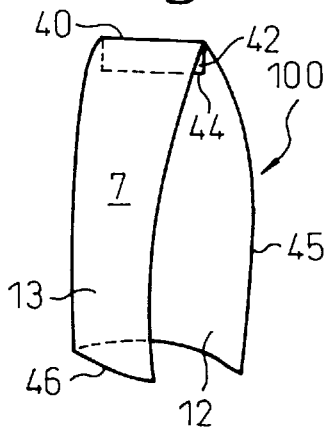
Figure 4C:
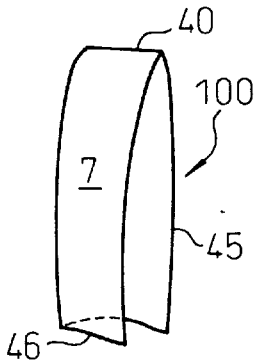
FIG. 4C is a perspective cross-sectional view for explaining FIG. 4A.

FIGS. 4A and 4B show examples of a lint-free wiper (100) formed of a bag-like fabric of a plain knit knitted with a single yarn fed through one yarn-feeding port. FIG. 4F shows the wiper of FIG. 4B turned over. FIG. 4C shows a cross-section the wiper shown in FIG. 4A taken along a line A—A. Similarly, FIGS. 4D and 4E show cross-sections of the wipers, respectively, shown in FIGS. 4B and 4F taken along lines B—B and C—C, respectively.

FIG. 4A shows a lint-free wiper composed of a bag-like shaped knitted fabric which is basically a cylindrical knitted fabric wherein one of course-directional edges is closed (40). FIG. 4B shows a lint-free wiper having a cross-section shown in FIG. 4D wherein, after one of the course-directional edges is closed (40), a flat knitted fabric (42) is added for preventing the edge from being unraveled. According to the wiper shown in FIG. 4F, the flat knitted portion (42) is brought into the inside (12) of the bag portion and is not exposed on a surface (13) substantially forming the wiping surface, whereby the knitted fabric is not easily unraveled.

These wipers of a bag-like shaped knitted fabric may be produced by using, for example, a so-called flat knitting machine or, preferably a full-fashion knitting machine. The conditions for the flat knitting machine and the stitch structure are the same as those of the flat knitted fabric, and there is imposed no particular limitation provided attention is given to making the ends not easy to unravel and decreasing the number of yarns that are fed. To knit a bag-like shaped knitted wiper by using a flat knitting machine, the beginning end portion (46) of a cylindrically shaped knitted fabric is initially knitted in a tubular plain knit, and the knitting operation is effected last to close the cylindrically shaped knitted fabric. When the end portion of the cylindrically shaped knitted fabric is closed by a stitch-transfer method or a linking method, there is obtained a knitted wiper of a bag-like shaped structure in which the end is closed on one side in the course direction (for example, see FIG. 4A). In this case, a flat knitted portion may be formed at the end of the knitting operation (for example, FIG. 4B).

Also, when a flat knitted portion is formed at the end of the knitting operation, this portion may be curled, or after the fabric has been completed, the fabric may be turned inside out to bring the flat knitted portion into inside (for example, FIG. 4F).

(4) Production of wiper composed of tubular structure with closed ends knitted fabric.

Figure 5D:
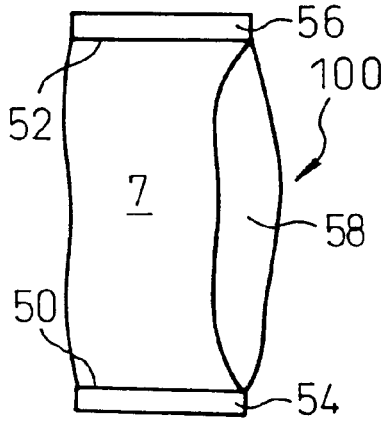
FIG. 5D is a perspective cross-sectional view for explaining FIG. 5B.

FIGS. 5A and 5B show examples of a lint-free wiper (100) composed of a tubular with closed ends knitted fabric of plain stitch structure knitted with a single yarn fed through one yarn-feeding port. FIGS. 5C and 5D show cross-sections, respectively, taken along a line (55) in FIGS., 5A and 5B.

The lint-free wiper shown in FIG. 5A is composed of a tubular knitted fabric closed at opposite course-directional ends (50, 52), between which a tubular portion (58) is defined. The lint-free wiper shown in FIG. 5B is also composed of a tubular knitted fabric closed at opposite course-directional ends (50, 52) by flat knitted portions (54, 56) added for the purpose preventing the fabric being unraveled, between which a tubular portion (58) is defined. These wipers can be produced by using a so-called flat knitting machine or, preferably, a full-fashion knitting machine. The conditions for the flat knitting machine and the knitting structure are the same as those of the flat knitted fabric, and no particular limitation is imposed provided attention is given too making the ends difficult to unravel and to decreasing the number of yarns that are fed. For example, when the tubular structure with closed ends knitted fabric shown in FIG. 5A is knitted by a flat knitting machine, initially a start course is formed by a drawn-yarn knit (bag-stop knit), a picot knit, a wind-stop knit or a shake-stop knit. Thereafter, a stitch-transfer knit (50) is carried out and the tubular portion of a tubular plain knit is formed. Then, the stitch-transfer knit is effected (52) to close the tubular portion. Further, the knitting operation is terminated in a stitch structure which is not easily unravelled or a linking method to result in a wiper of a tubular structure with closed ends knitted fabric. Also, flat knitted portions (54, 56) may be provided in the starting and finishing sections (for example, FIG. 5B).

(5) Production of lint-free wiper composed of cylindrically shaped knitted fabric FIG. 6A shows an example of a lint-free wiper (100) of a cylindrically shaped fabric knitted with a single yarn. FIGS. 6B and 6C are cross-sectional views of FIG. 6A, wherein opposite ends thereof are curled (8). The cylindrically shaped knitted fabric is curled outward (13) in FIG. 6B, while the cylindrically shaped knitted fabric is curled inward (12) in FIG. 6C. In view of the ease, of handling, inward curling (12) is preferable, as shown in FIG. 6C, because the wiping surface (13) becomes smooth to eliminate catching during the wiping operation.

The wiper of the cylindrically shaped knitted fabric may be produced by using a so-called flat knitting machine, preferably a full-fashion knitting machine, or a circular knitting machine. The conditions for the flat knitting machine and the stitch structure are the same as those for the planar knitted fabric, and no particular limitations is imposed provided attention is given to making the ends unlikely to be unravelled and feeding the yarns in a decreased number. The circular knitting machine may be either a single type or a double type. A cylinder diameter of the circular knitting machine is suitably selected depending upon the functions required for the product, i.e., a size of the wiper, the property of the fiber material and a knit design. Usually, the cylinder diameter is in a range from 2 to 40 inches, preferably from 4 to 30 inches. A gauge of the circular knitting machine, i.e., the number of needles per inch, may be suitably selected depending upon the properties required for the products. Usually the gauge is in a range from 20 to 42, preferably from 24 to 36. The number of yarns to be fed for the knitting operation is preferably smaller from the standpoint of decreasing fiber fall-off. Usually, the number of yarns to be fed is in a range from 1 to 60, preferably from 1 to 24. The stitch structure may be a combination of knit, tuck and welt. Although there is no limitation in the stitch structure, the stitch structure of the start-course and the stop-course is preferably unlikely to be unraveled.

For the purpose of causing the course-directional end portion of the cylindrically shaped knitted fabric to be curled as shown in FIGS. 6B and 6C, a hard-twisted yarn may be used for solely forming the end portion or a loop size may be varied or a double-layer structure may be adopted, wherein each of inner and outer layers is formed of a yarn having a different hot-water shrinkage from the other.

(6) Production of lint-free wiper composed of cylindrically shaped knitted fabric with hollow structural portions FIGS. 7A and 7D show examples of a lint-free wiper (100) formed of a cylindrically shaped knitted fabric (7) of a plain stitch structure having a hollow structural portion, which is knitted with a single yarn. FIGS. 7B and 7C show cross-sections of FIG. 7A, respectively. FIG. 7B shows that the wiper of FIG. 7A is formed of a hollow structural portion (9) and a single-plied knitted fabric (10), while FIG. 7C shows that the single-plied knitted fabric (10) is curled (8). FIG. 7E shows a cross-section of FIG. 7D wherein the hollow structural portion (9) is rotated to displace the single-piled knitted fabric (10) to the inside (12) of the cylindrical portion.

Figure 8A:
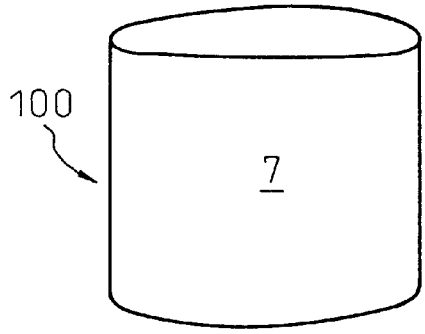
FIG. 8A is an explanatory view of one example of a wiper formed of a cylindrically shaped knitted fabric having two hollow structures according to the present invention.
Figure 8B:
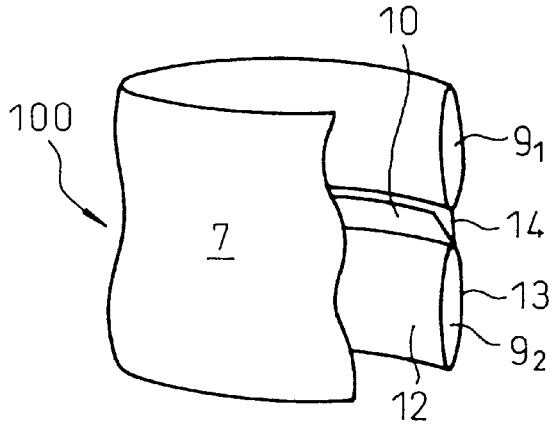
FIGS. 8B and 8C are perspective cross-sectional views for explaining FIG. 8A.
Figure 8C:
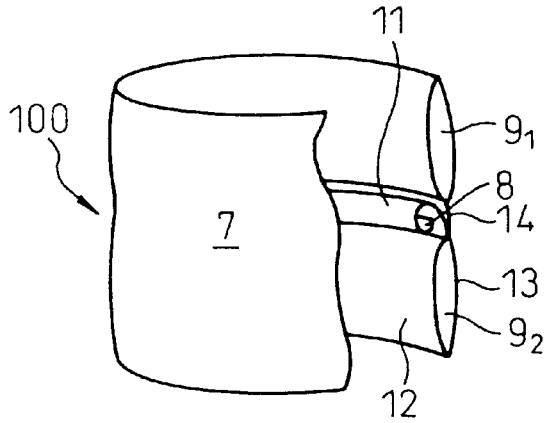

FIG. 8A shows an example of a lint-free wiper (100) formed of a cylindrically shaped knitted fabric (7) having two hollow structural portions, which is knitted with a single yarn. FIGS. 8B and 8C show cross-sections of FIG. 8A, respectively, wherein the wiper consists of hollow structural portions (9-1, 9-2), a single-plied connecting portion (14) for connecting them, and a single-plied structural knitted fabric (10) coupled to both of the extremity hollow structural portions (9-2) and the single-plied connecting portion (14). A wiping surface of the wiper is positioned on outside (13) and the single-plied structural knitted fabric (10) is positioned on inside (12) of the cylindrical portion. FIG. 8C shows that the single-plied structure (10) is curled (8).

Figure 9A:
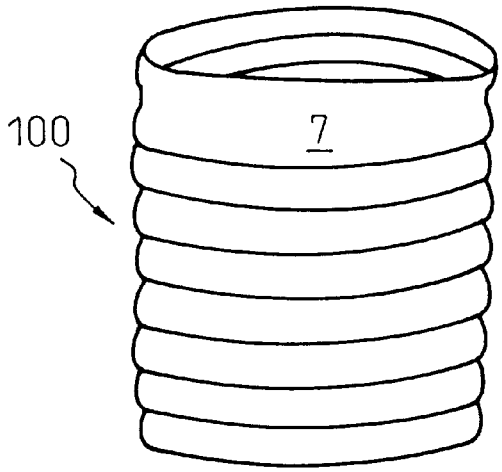
FIG. 9A is an explanatory view of one example of a wiper formed of a cylindrically shaped knitted fabric having a plurality of hollow structures according to the present invention.
Figure 9B:
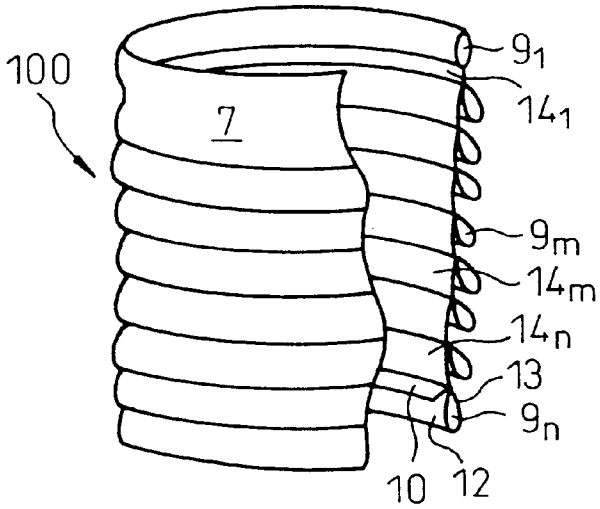
FIG. 9B is a perspective cross-sectional view for explaining FIG. 9A.

Further, FIG. 9A shows an example of a lint-free wiper (100) formed of a knitted fabric (7) of a plain stitch structure having a plurality of hollow structural portions, which is knitted with a single yarn. FIG. 9B shows a cross-section of FIG. 9A, wherein the wiper consists of a plurality of hollow structural portions (9-1, 9-m, 9-n), single-plied connecting portions (14-1, 14-m, 14-n) connected to them, and a single-plied structure (10) coupled to both of the extremity hollow structural portion (9-n) and the single-plied connecting portion (14-n). A wiping surface of the wiper is positioned on outside (13) and the single-plied structure (10) is positioned on inside (12) of the cylindrical portion.

For example, when the fabric is knitted by using a single cylinder knitting machine, the needles of the cylinder are alternately lifted up in the hollow structure starting portion so that a yarn is temporarily held therebetween. The normal knitting operation is carried out from the next course. After the courses required for the hollow structural portion have been knitted, the yarn held in the starting portion is simultaneously knitted and coupled to thereby form the hollow structural portion. Thereafter, the normal knitting operation continues to produce a knitted fabric having a hollow structural portion and a single-plied structure. If the knitting operation is terminated at this moment, the product of the present invention (for example, FIG. 7A) is obtained. Furthermore, if the hollow structural portion is knitted again by the same method as that for initially knitting the hollow structural portion, a knitted fabric having two hollow structural portions is obtained. In this case, the previously knitted single-plied structure provides the single-plied connecting portion. If the normal knitting operation is carried out thereafter, a single-plied structure is obtained. If the knitting operation has been completed at this instant, a wiper having two hollow structural portions (FIG. 8A) is obtained.

By repeating the above-mentioned knitting steps, a knitted fabric having many hollow structural portions, as shown in FIG. 9A, is obtained. As described before, the fabric end is preferably terminated as a single-plied structure from the standpoint that the end yarns are not caught during the handling or use and are not unraveled and lint or fiber fall-off are generated. The cut ends of the yarns are preferably exposed to the outer surface as little as possible. Therefore, when the fabric is formed of a plurality of yarns, the yarns are preferably successively cut at the termination of knitting operation, and the ends of the yarns, except for one yarn, are knitted into loops of the knitted fabric. Further, the single-plied structure is curled inward to conceal the cut ends of the yarns, so that the ends of the yarns are not exposed outside. This makes possible to reduce the generation of dust from the wiper.

The cylindrically shaped knitted fabric having hollow structural portions may be produced by using a so-called single cylinder knitting machine or others. A cylinder diameter of the knitting machine is suitably selected depending upon the functions required for the product, i.e., a size of the wiper, property of the fiber material and a knit design. Usually, the cylinder diameter is in a range from 2 to 20 inches, preferably from 4 to 16 inches. The gauge of the circular knitting machine, i.e., the number of needles per inch, may be suitably selected depending upon the properties required for the products. Usually thee gauge is in a range from 20 to 42, preferably from 24 to 36. The number of yarns to be fed for the knitting operation is preferably smaller from the standpoint of decreasing fibers fall-off. Usually, the number of yarns to be fed is in a range from 1 to 60, preferably from 1 to 24.

The stitch structure is may be a combination of knit, tuck and welt. Although there is no limitation in the stitch structure, the stitch structure is preferably a plain knit, a 1:1 tuck knit and 1:3 tuck knit. The 1:1 tuck knit stands for the one which is knitted in a tuck every other wale (stitch in the wale direction), and is knitted in the next course (stitch in the course direction) in a tuck every other wale being deviated by one wale from the preceding course. The 1:3 tuck knit stands for the one which is knitted in a tuck every three other wales and in the next course, is knitted in a tuck every three other wales being deviated by one wale. The plain knit is desired when the plating method is effected for obtaining a knitted fabric of the double-layer structure by using two or more kinds of fiber materials. This is because the direction of the material can easily be controlled. The knitted fabric is suitably designed to meet the functions of the knitting machine by taking the use and properties thereof into consideration. In particular, the knitting conditions may be so selected that polyester fibers substantially appear on the side of the wiping surface and cellulosic fibers substantially appear on the opposite side. Further, a stitch size may be partially changed to form a continuously knitted fabric to facilitate the functions such as stretchability or ease of handling.

EXAMPLES

The present invention will now be described below in further detail by way of Examples, but should not be limited thereto. In these Examples, the properties were measured in the following manner.

(1) Dry type evaluation of number of lints (beating):

The sample is suspended in air and is beaten with a rod at 120 times a minute. Particles of not smaller than 0.3 $\mu$m emitted into air are measured by using a particle counter and calculated as the number per one cubic foot.

(2) Dry type evaluation of number of lints (expansion and contraction):

The sample is gripped at its both ends in air, and is repeatedly drawn by 5% 60 times in the transverse direction and the longitudinal direction. Particles of not smaller than 0.3 $\mu$m emitted into air are measured by using a particle counter and calculated as the number per one cubic foot.

(3) Wet type evaluation of number of lints:

Measured according to a method stipulated under the IES-RP-CC-004.2 (measurement recommended by the Institute of Environmental Science, USA). The wiper was immersed and shaken in water for 5 minutes under the minimum stress. Particles of not smaller than 0.5 $\mu$m are measured by using a particle counter and are calculated for 1 $m^2$ of the sample.

(4) Measurement of liquid-absorption capacity:

Measured in accordance with the above-mentioned method IES-RP-CC-004.2, and reckoned as a volume absorbed per unit mass.

(5) Measurement of fiber fall-off:

The sample is immersed in 300 ml of pure water, ultrasonic wave was applied for 15 minutes, and the sample was taken out. The liquid is filtered by using a filter paper colored black, and the fibers fall-off from the wiper left on the filter paper is measured. Fibers having a length of 100 $\mu$m or more are counted and calculated for 1 $m^2$ of the sample.

(6) Measurement of Extractables:

The wiper is immersed at a ratio of 50 g in 800 ml of several liquids and left to stand for 24 hours. Then, the wiper is taken out, the remaining liquid was evaporated and completely solidified, and the weight thereof is calculated for 1 $m^2$.

Example 1

A woven fabric of a plain weave structure was prepared by using a shuttle loom. A polyester multi-filamentary yarn (56 dtex/36 f) was used as a warp yarn at a reed density of 97 ends inch and a polyester multi-filamentary yarn (83 dtex/36 f) was used as a weft yarn at a weft density of 80 ends inch. First, the edge of the warp-wise direction was made by feeding the warp yarn without inserting the weft yarn and, then, the weft yarn was fed by a shuttle. At a time when the woven fabric of a predetermined length was obtained, a portion that served as another edge of the warp-wise direction was formed again by feeding the warp yarn but without inserting the weft yarn. 1358 warp yarns were warped, and the weft yarns were prepared as usual. The portion to which the warps were solely fed was cut at a distance of about 1 cm from a portion into which the weft yarns were inserted. Then, the fabric was folded twice or more in order to form loops including the woven fabric as shown, for example, in FIG. 1B. Next, the folded portion was sewn to be prevented from unraveling. The resultant wiper had a size of, 35 cm×35 cm.

The resultant woven fabric wiper was washed in a washing machine installed in a clean room to remove dirt, spinning oil and oil used during the weaving operation. Thereafter, the wiper was dried and packaged with a polyolefin film to provide a lint-free wiper in the clean room. As shown in Table 1, the wiper contained very few micro lints and little fiber fell-off, and was suited for use in a high grade clean room.

Example 2

Using a tricot knitting machine of 32 gauge/inch, a loop-forming portion of an edge in a half-tricot stitch structure was first knitted from polyester multi-filamentary yarns (56 dtex/36 f) used as both of front and back yarns by simply feeding the yarns without effecting the knitting operation. Then, a main body which serves as a wiping portion was knit, and, finally, a loop-forming portion of an edge was knit again without effecting the knitting operation. 600 front yarns and 601 back yarns were warped and prepared as usual. A non-knitted portion serving as a course-directional edge was cut at a distance of about 1 cm from the knitted portion, and folded twice or more to form loops including the knitted portion in the same manner as in Example 1. The folded portions were then sewn to prevent unraveling. The resultant fabric had a width of 47 cm and a length of 26 cm.

The obtained knitted fabric was treated in the same manner as in Example 1 to result in a lint-free wiper of 30 cm wide and 30 cm long. As shown in Table 1, the wiper contained very few lints and little fiber fell-off, and was suited for use in a high grade clean room.

Example 3

By using a full-fashion knitting machine of 30 gauge/1.5 inches, a three-plied yarn (three-folded yarn) of false-twisted polyester multi-filamentary yarns (83 dtex/36 f) was knitted through a single yarn-feeding port. First, a starting portion was formed with a drawn-yarn stitch structure which was not easily unraveled, and then knitted with a plain stitch structure. The knitting end portion was linked to prevent unraveling to obtain a flat knitted fabric wiper of 20 cm wide and 20 cm long.

The obtained knitted fabric was treated in the same manner as in Example 1 to obtain a lint-free wiper. As shown in Table 1, the wiper contained very few lints and little fiber fell-off, and was suited for use in a high grade clean room.

Example 4

By using a full-fashion knitting machine of 30 gauge/1.5 inches, a three-plied yarn (three-folded yarn) of false-twisted polyester multi-filamentary yarns (83 dtex/36 f) was knitted through a single yarn-feeding port. From the start, a tubular plain stitch structure was formed, and then, a loop transferring knit was effected to knit a fabric of a smooth stitch structure. The start-course and the stop-course were linked to prevent unraveling, and a bag-like shaped knitted fabric was obtained, as shown in FIG. 4B, which had a width of 20 cm, a length of a bag portion of 20 cm and a length of a flat portion of 1 cm.

The obtained knitted fabric was treated in the same manner as in Example 1 to obtain a lint-free wiper. As shown in Table 1, the wiper contained very few lints and little fiber fell-off, and was suited for use in a high grade clean room.

Example 5

By using a full-fashion knitting machine of 30 gauge/1.5 inches, a three-plied yarn (three-folded yarn) of false-twisted polyester multi-filamentary yarns (83 dtex/36 f) was knitted through a single yarn-feeding port. First, a starting portion was formed with a ravelling cord for preventing fraying, then transferring stitch so as to knit a tubular part with a hollow plain stitch structure, and thereafter transferring stitch to form a smooth stitch structure. Further, an anti-fraying treatment was effected on the knitted end portion by means of linking to obtain a tubular structure with closed ends knitted fabric shown in FIG. 5B, having a width of 20 cm, a length of a tubular portion of 20 cm and a length of a flat knitted portion at the beginning and final ends of 1 cm.

The obtained knitted fabric was treated in the same manner as in Example 1 to obtain a lint-free wiper. As shown in Table 1, the wiper contained very few lints and little fiber fell-off, and was suited for use in a high grade clean room.

Example 6

By using a flat knitting machine of 20 gauge/inch, a three-plied yarn (three-folded yarn) of false-twisted polyester multi-filamentary yarns (83 dtex/36 f) was knitted through a single yarn-feeding port to form a tubular plain stitch structure. An anti-fraying treatment was effected on the knitting starting and end portions by means of linking to obtain a cylindrically shaped knitted fabric shown in FIG. 6A having a circumferential length of 40 cm and a length of 20 cm.

The obtained knitted fabric was treated in the same manner as in Example 1 to obtain a lint-free wiper. As shown in Table 1, the wiper contained very few lints and little fiber fell-off, and was suited for use in a high grade clean room.

Example 7

By using a double circular knitting machine having a cylinder diameter of 13 inches and the needle arrangement of 28 gauge/inch, a cylindrically shaped knitted fabric having a circumferential length of 70 cm was knitted with four false-twisted polyester multi-filamentary yarns (83 dtex/36 f) through four yarn-feeding ports to form a smooth stitch structure. The length of the cylindrical portion was 35 cm. The course-directional ends of the fabric were naturally curled to have a cross-sectional shape as shown in FIG. 6B.

The obtained knitted fabric was treated in the same manner as in Example 1 to obtain a lint-free wiper. As shown in Table 1, the wiper contained very few lints and little fiber fell-off, and was suited for use in a high grade clean room.

Example 8

By using a single cylinder knitting machine having a cylinder diameter of 13 inches and the needle arrangement of 28 gauge/inch a cylindrically shaped knitted fabric having a circumferential length of 70 cm was knitted with four false-twisted polyester multi-filamentary yarns (83 dtex/36 f) through four yarn-feeding ports to form a plain stitch structure. The length of the cylindrical portion was 30 cm. The course-directional ends of the fabric were naturally curled to have a cross-sectional shape as shown in FIG. 6B. To facilitate the ease of handling, the fabric was turned inside out so that the cross sectional shape shown in FIG. 6C is obtained. The obtained knitted fabric was treated in the same manner as in Example 1 to obtain a lint-free wiper. As shown in Table 1, the wiper contained very few lints and little fiber fell-off, and was suited for use in a high grade clean room.

Example 9

By using a single type circular knitting machine having a cylinder diameter of 4 inches and a needle arrangement of 32 gauge/inch, a cylindrically shaped knitted fabric which had a hollow structure and a single-plied structure, having a circumferential length of 20 cm was knitted with four false-twisted polyester multi-filamentary yarns (83 dtex/36 f) through four yarn-feeding ports to form a plain stitch structure. The length of the hollow structural portion was 10 cm, and that of the single-plied portion was 1 cm. The single-plied portion was naturally curled to have a cross-sectional shape as shown in FIG. 7C.

The obtained knitted fabric was treated in the same manner as in Example 1 to obtain a lint-free wiper. As shown in Table 1, the wiper contained very few lints and little fiber fell-off, and was suited for use in a high grade clean room.

Example 10

By using a single cylinder knitting machine having a cylinder diameter of 4 inches and the needle arrangement of 28 gauge/inch, a double-layer cylindrically shaped knitted fabric which had a hollow structure and a single-plied structure, having a circumferential length of 18 cm was knitted with four false-twisted polyester multi-filamentary yarns (83 dtex/36 f and four cupra-ammonium rayon filamentary yarns (33 dtex/24 f) through four yarn-feeding ports each other, to form a plain stitch structure so that the polyester yarn component was disposed in the outer layer and the cupra-ammonium rayon yarn component was disposed in the inner layer by means of plating. The length of the hollow structure portion was 9 cm and that of the single-plied structural portion was 1 cm. The hollow structural portion was turned to contain the single-plied structural portion with in the cylindrically shaped knitted fabric. The knitted fabric had a cross-sectional shape as shown in FIG. 7E.

The obtained knitted fabric was treated in the same manner as in Example 1 to obtain a lint-free wiper. As shown in Table 1, the wiper contained very few lints and little fiber fell-off. Particularly, this wiper was significantly improved in liquid-absorption capacity to be suitable for wiping off a liquid, and was suited for use in a high grade clean room.

Example 11

A lint-free wiper was prepared in the same manner as in Example 9, except for adopting a composite yarn composed of a sheath portion of polyester multi-filamentary yarn (83 dtex/36 f) and a core portion of cupra-ammonium rayon multi-filamentary yarn (33 dtex/24 f).

As shown in Table 1, the wiper exhibited an excellent wiping capacity, and was suited for use in a high grade clean room.

Example 12

By using a single cylinder knitting machine having a cylinder diameter of 4 inches and the needle arrangement of 32 gauge/inch, a cylindrically shaped knitted fabric was obtained from four polyester multi-filamentary yarns through four yarn-feeding ports, by continuously knitting a structure having two hollow structural portions connected with each other via a single-plied structure connecting portion, and then, knitting a further single-plied structural portion from the connecting part to form a plain stitch structure without the connecting part of the hollow structure. Each of the hollow structural portions had a circumferential length of 20 cm and a course-directional length of 4 cm. The single-plied connecting portion connecting the hollow structural portions with each other had a circumferential length of 20 cm and a course-directional length of 1 cm, and the further single-plied structural portion added to the connecting part also had a circumferential length of 20 cm and a course-directional length of 1 cm. Each of the hollow structural portions had a circumference of 20 cm and a length of 4 cm. The single-layer connecting part connecting the hollow structural portions with each other had a circumference of 20 cm and a length of 1 cm, and the further single-layer structural portion added to the connecting part also had a circumference of 20 cm and a length of 1 cm.

The obtained knitted fabric was treated in the same manner as in Example 1 to obtain a lint-free wiper. A cross-sectional shape of the wiper was that shown in FIG. 8E. As shown in Table 1, the wiper exhibited an excellent wiping capacity, and was suited for use in a high grade clean room.

Example 13

By using a single cylinder knitting machine having a cylinder diameter of 4 inches and the needle arrangement of 26 gauge/inch, a cylindrically shaped knitted fabric of substantially a double-layer structure was obtained from four false-twisted polyester multi-filamentary yarns (83 dtex/36 f) and four cupra-ammonium rayon filamentary yarns (33 dtex/24 f) through four yarn-feeding ports each other, to form a plain stitch structure so that the polyester yarn component was presented in the outer layer and the cupra-ammonium rayon yarn component was disposed in the inner layer by means of plating. The cylindrically shaped knitted fabric was obtained by continuously knitting a structure having two hollow structural portions connected with each other via a single-plied structure connecting portion, and then, knitting a further single-plied structural portion from the connecting part to form a plain stitch structure without the connecting part of the hollow structure. Each of the hollow structural portions had a circumferential length of 20 cm and a course-directional length of 4 cm. The single-plied connecting portion connecting the hollow structural portions with each other had a circumferential length of 20 cm and a course-directional length of 1 cm, and the further single-plied structural portion added to the connecting part also had a circumferential length of 20 cm and a course-directional length of 1 cm.

The obtained knitted fabric was treated in the same manner as in Example 1 to obtain a lint-free wiper. A cross-sectional shape of the wiper was that shown in FIG. 8E. As shown in Table 1, the wiper exhibited the same excellent wiping capacity as in Example 10.

Example 14

A lint-free wiper was prepared in the same manner as in Example 12, except for adopting a composite yarn composed of a sheath portion of polyester multi-filamentary yarn (83 dtex/36 f) and a core portion of cupra-ammonium rayon multi-filamentary yarn (33 dtex/24 f).

As shown in Table 1, the wiper exhibited an excellent wiping capacity, and was suited for use in a high grade clean room.

Comparative Example 1

The results are shown, in Table 1, which were measured in the same manner as above, of the physical properties of a high-quality clean room wiper TX1009 (a knitted fabric composed of 100% polyester fibers, which is cut along four sides and heat-cut) available from Texwipe Co., Ltd. Although the values such as for lint and the extractables were not problematic in usage, a large amount of lint and fiber fall-off was observed in practical use accompanied with the repetition of expansion/contraction motions.

Comparative Example 2

The results are shown, in Table 1, which were measured in the same manner as above, of physical properties of a high-quality clean room wiper TX1010 (a knitted fabric -composed of 100% polyester fibers, which is cut along four sides and heat-sealed) available from Texwipe Co., Ltd. Although the values, such as for lint and the extractables were not problematic in usage, a large amount of lint and fiber fall-off was observed in practical use accompanied with the repetition of expansion/contraction motions. Further, the edge face was so hard that the ease of handling was not good. Thus there was a risk in that the wiper may damage a delicate object when the wiper was used for wiping the same.

Comparative Example 3

The results are shown, in Table 1, which were measured in the same manner as above, of physical properties of a high-quality clean room wiper Savina-Minimax (a knitted fabric composed of polyester and polyamide fibers, which is cut along four sides and heat-cut) available from Kanebo Gosen K.K. Although the values such as for lint and the extractables were not problematic in usage, a large amount of lint and fiber fall-off was observed in a practical use accompanied with the repetition of expansion/contraction motions.

TABLE 1

| | Unit | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 | C. Ex. 1 | C. Ex. 2 | C. Ex. 3 |
|---|---|---|---|---|---|---|---|---|---|---|---|---|---|---|---|---|---|---|
| Shape of wiper (Number of layer) | — | Plain (1) | Plain (2) | Plain (1) | Bag-like (1) | TSCS (1) | CS (1) | CS (1) | CS (1) | CSHS (1) | CSHS (1) | CSHS (1) | CS-THS | CS-THS (1) | CS-THS (2) | Plain (1) | Plain | Plain |

TABLE 1-continued

| | Unit | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 | C. Ex. 1 | C. Ex. 2 | C. Ex. 3 |
|---|---|---|---|---|---|---|---|---|---|---|---|---|---|---|---|---|---|---|
| Size of fabric (Extended) | cm × cm | 35 × 35 | 30 × 30 | 20 × 20 | 20 × 41 | 20 × 42 | 20 × 40 | 70 × 35 | 70 × 30 | 20 × 21 | 18 × 19 | 20 × 21 | 20 × 18 | 20 × 18 | 20 × 18 | 23 × 23 | 24 × 24 | 23 × 23 |
| Number of fabric cut line | — | none | none | none | none | none | none | none | none | none | none | none | none | none | none | 4 | 4 | 4 |
| Number of cut yarn | number/sheet | 2718 | 2402 | 2 | 2 | 2 | 2 | 8 | 8 | 8 | 16 | 8 | 8 | 16 | 8 | innumerable | innumerable | innumerable |
| Dry microlint generation (Beating) | number/CF | 220 | 200 | 80 | 40 | 60 | 80 | 140 | 150 | 120 | 190 | 180 | 100 | 170 | 160 | 230 | 170 | 260 |
| Dry microlint generation (Expansion & Contraction) | number/CF | 180 | 170 | 40 | 60 | 40 | 50 | 80 | 60 | 70 | 80 | 40 | 40 | 60 | 40 | 400 | 210 | 480 |
| Wet microlint generation | million/$m^2$ | 1.9 | 2.1 | 0.5 | 0.7 | 0.7 | 0.6 | 1.7 | 1.6 | 1.1 | 1.7 | 1.7 | 2.0 | 1.5 | 1.6 | 2.8 | 2.2 | 3.3 |
| Fibers fall-off | hundred/$m^2$ | 3 | 2 | less than 1 | less than 1 | less than 1 | less than 1 | less than 1 | less than 1 | less than 1 | less than 1 | less than 1 | less than 1 | less than 1 | less than 1 | 24 | 9 | 40 |
| Extractable (Water) | mg/$m^2$ | 10 | 14 | 8 | 7 | 7 | 10 | 12 | 13 | 16 | 8 | 10 | 12 | 7 | 9 | 24 | 20 | 44 |
| Extractable (IPA) | mg/$m^2$ | 35 | 42 | 26 | 37 | 45 | 38 | 47 | 52 | 75 | 40 | 42 | 81 | 46 | 35 | 105 | 100 | 140 |
| Absorbency | ml/g | 2 | 3 | 2 | 3 | 3 | 3 | 3 | 3 | 3 | 8 | 8 | 3 | 9 | 9 | 2 | 2 | 2 |

note:
1 TSCS tubular structure with closed ends
2 CS Cylindrical shape
CSHS Cylindrical shape with one hollow structure
CSTHS Cylindrical shape with two hollow structures

CAPABILITY OF EXPLOITATION IN INDUSTRY

The lint-free wiper according to the present invention is formed of a fabric having an edge structure substantially consisting of loops of yarns constituting, the fabric. Accordingly, the lint-free wiper substantially contains no cut ends of yarns in the structure thereof which are a source from which lint and/or fibers are released. Thus, according to the lint-free wiper of the present invention, the generation of dust is significantly suppressed, which means that the wiper can be used in a high-grade clean room of at least Class 100 with no fear of contamination.

Since the function for suppressing the dust generation of the lint-free wiper of the present invention is based on a fabric structure having the edge formed of loops constituting the fabric, it is unnecessary to fusion-bond or adhere fibers with each other for the purpose of providing a function of suppressing the dust generation. Thereby, non-thermoplastic fibers such as cellulosic fibers can be used for the production there of, and it is possible to provide a highly soft lint-free wiper having softness and excellent wiping function.

Particularly, since the wiper according to the present invention may be of various shapes and/or structures when the same is manufactured by a flat knitting machine or a circular knitting machine, it is possible to eliminate the cutting operation and the subsequent fusion-bonding operation. Also, it is possible to design and provide wipers exceedingly lint-free with excellent reliability in accordance with various uses.

What is claimed is:

1. A lint-free wiper comprising a cylindrically shaped knitted fabric structure having edge portions substantially formed of loops of yarn constituting the knitted fabric, said fabric structure being formed of a piece of cylindrically shaped knitted fabric having two opposed ends that are brought together and connected to form a cylindrical hollow structural portion and a cylindrical single-plied structural portion connected to the cylindrical hollow structural portion, said knitted fabric being composed of multifilament yarn made from a plurality of single filaments having a thickness of from 0.05 dtex to 5 dtex.

2. The lint-free wiper according to claim 1, wherein the cylindrically shaped knitted fabric structure has a plurality of cylindrical hollow structural portions which are connected to each other by a cylindrical single-plied connection portion formed from a Part of the cylindrically shaped knitted fabric.

3. The lint-free wiper according to claim 2, wherein the cylindrical single-plied structural portion is connected to the cylindrical single-plied connection portion and an extremity of one of the cylindrical hollow structural portions.

4. The lint-free wiper according to claim 1, wherein the cylindrical single-plied structural portion is disposed at an edge portion or inner side of the cylindrically shaped knitted fabric structure.

5. The lint-free wiper according to 1, wherein an edge portion of the cylindrically shaped knitted fabric is curled.

6. The lint-free wiper according to claim 1, wherein the yarn of the knitted fabric is a multifilament yarn made from non-circular cross-sectional fibers.

7. The lint-free wiper according to claim 1, wherein the yarn of the knitted fabric is formed of cellulosic fibers.

8. The lint-free wiper according to claim 1, wherein the yarn of the knitted fabric is composite yarn formed of cellulosic fibers and synthetic fibers.

9. The lint-free wiper according to claim 8, wherein the composite yarn has a cellulosic fiber component as a core and a synthetic fiber component as a sheath.

10. The lint-free wiper according to claim 1, wherein the cylindrically shaped knitted fabric structure is substantially of a double-layered knitted fabric.

11. The lint-free wiper according to claim 10, wherein double-layered knitted fabric has a layer positioned on an inside face of the cylindrical hollow structural portion composed of at least one part of cellulosic fibers.

12. The lint-free wiper according to claim 2, wherein the cylindrically shaped knitted fabric structure is substantially of a double-layered knitted fabric, a part of which forms the cylindrical single-plied connecting portion, and a layer on an inside face of the cylindrical single-plied connecting portion is composed at least partly of cellulosic fibers.

13. The lint-free wiper according to claim 10, wherein the double-layered knitted fabric has a layer facing an outer side of the cylindrical hollow structural portion that consists substantially of a synthetic fiber having a single filament thickness of from 0.05 dtex to 2.0 dtex.

14. The lint-free wiper according to claim 2, wherein the cylindrically shaped knitted fabric structure is substantially of a double-layered knitted fabric, a part of which forms the cylindrical single-plied connecting portion, and a layer on an outside face of the cylindrical single-plied connecting portion is composed substantially of a synthetic fiber having a single filament thickness of form 0.05 dtex to 2.0 dtex.

15. A lint-free wiper formed of a cylindrically shaped knitted fabric having an edge portion substantially formed of loops of yarn constituting the knitted fabric, a cylindrical hollow structural portion and a cylindrical single-plied structure connected to the cylindrical hollow structural portion, wherein the cylindrically shaped knitted fabric is substantially of a double-layered knitted structure of which a layer positioned on an inside face of the cylindrical hollow structural portion contains electro-conductive fibers.

16. A lint-free wiper formed of a cylindrically shaped knitted fabric having an edge portion substantially formed of loops of yarn constituting the knitted fabric, a cylindrical hollow structural portion and a cylindrical single-plied structure connected to the cylindrical hollow structural portion, wherein the cylindrically shaped knitted fabric is substantially of a double-layered knitted structure, a part of which forms a cylindrical single-plied connection portion, and a layer positioned on an inside face of the cylindrically shaped knitted fabric forming the cylindrically single plied-connection portion contains electro-conductive fibers.

* * * * *